US007690405B2

(12) United States Patent
Miller et al.

(10) Patent No.: US 7,690,405 B2
(45) Date of Patent: Apr. 6, 2010

(54) MULTIPLE FLUID DISPENSER

(75) Inventors: William A. Miller, Buffalo Grove, IL (US); Tim Hogan, Round Lake Beach, IL (US); Christopher Khoo, Lake in the Hills, IL (US); Ryan Hanawalt, Cary, IL (US); Marty Leider, Lake Forest, IL (US); James R. Cleveland, Carpentersville, IL (US); Anton Obrecht, Arlington Heights, IL (US)

(73) Assignee: Fluid Management, Inc., Wheeling, IL (US)

( * ) Notice: Subject to any disclaimer, the term of this patent is extended or adjusted under 35 U.S.C. 154(b) by 1225 days.

(21) Appl. No.: 11/183,392

(22) Filed: Jul. 18, 2005

(65) Prior Publication Data

US 2007/0012378 A1 Jan. 18, 2007

(51) Int. Cl.
*B65B 3/12* (2006.01)
*B65B 3/26* (2006.01)
*B67C 3/02* (2006.01)

(52) U.S. Cl. ..... 141/104; 141/9; 141/86; 141/236; 222/63; 222/135; 222/383.2

(58) Field of Classification Search ..... 141/234, 141/18, 168, 104, 100, 83, 9, 236, 86, 87; 222/135, 333, 63, 383.2
See application file for complete search history.

(56) References Cited

U.S. PATENT DOCUMENTS 4,871,262 A 10/1989 Krauss et al.
5,078,302 A 1/1992 Hellenberg
5,116,134 A 5/1992 Edwards et al.
5,119,973 A 6/1992 Miller et al.

(Continued)

FOREIGN PATENT DOCUMENTS

DE 4110299 C1 2/1993

(Continued)

OTHER PUBLICATIONS

International Searching Authority "*International Preliminary Report on Patentability*", Jan. 31, 2008, 12 Pages.

(Continued)

*Primary Examiner*—Gregory L Huson
*Assistant Examiner*—Nicolas A Arnett
(74) *Attorney, Agent, or Firm*—Miller Matthias & Hull

(57) ABSTRACT

An improved multi fluid dispenser for simultaneous dispensing of a plurality of fluids shown and described. The dispenser includes a controller that is linked to a coordinator board. The controller has a memory with a plurality of recipes stored in the memory. A coordinator board is linked to a first module. The first module may include one or two pumps, each connected to a fluid reservoir. The module is then linked in series to a plurality of other modules as well as a manifold module. Each module includes a module board for controlling the pump or pumps of that module. The controller, coordinator board and module boards are all programmed for the simultaneous or sequential pumping of multiple fluids from the reservoirs through outlet nozzles of the manifold in accordance with a recipe selected by the user and retrieved from the memory of the controller.

15 Claims, 16 Drawing Sheets

U.S. PATENT DOCUMENTS

| | | | | |
|---|---|---|---|---|
| 5,328,057 | A | 7/1994 | Hellenberg et al. | |
| 5,622,692 | A | 4/1997 | Rigg et al. | |
| 5,690,252 | A | 11/1997 | Oleksiewicz et al. | |
| 5,697,527 | A | 12/1997 | Altieri, Jr. et al. | |
| 5,711,458 | A | 1/1998 | Langeveld et al. | |
| 5,785,960 | A | 7/1998 | Rigg et al. | |
| 6,273,298 | B1 | 8/2001 | Post | |
| 6,398,513 | B1 | 6/2002 | Amsler et al. | |
| 6,510,366 | B1 | 1/2003 | Murray et al. | |
| 6,540,486 | B2 | 4/2003 | Amsler et al. | |
| 6,689,410 | B2 * | 2/2004 | Gerber | 222/135 |
| 6,726,065 | B2 * | 4/2004 | Sanders | 222/63 |
| 6,749,402 | B2 | 6/2004 | Hogan et al. | |
| 6,926,171 | B2 | 8/2005 | Reedy et al. | |
| 6,935,386 | B2 | 8/2005 | Miller et al. | |
| 7,164,966 | B2 * | 1/2007 | Sudolcan | 700/239 |
| 7,320,416 | B2 * | 1/2008 | Miller et al. | 141/271 |
| 2003/0116584 | A1 * | 6/2003 | Gutierrez et al. | 222/1 |
| 2005/0092386 | A1 * | 5/2005 | Kaufhold et al. | 141/9 |
| 2007/0044863 | A1 * | 3/2007 | Engels et al. | 141/83 |

FOREIGN PATENT DOCUMENTS

| | | |
|---|---|---|
| EP | 0 427 497 | 11/1960 |
| EP | 0443741 B1 | 6/1995 |
| EP | 1 125 643 | 1/2001 |
| WO | WO 86 02320 | 4/1986 |
| WO | WO 86 03235 | 6/1986 |
| WO | WO 2007/052016 | 5/2007 |

OTHER PUBLICATIONS

International Searching Authority, "*Partial Search Report*", Apr. 25, 2007, 3 Pages.

International Searching Authority, "*International Search Report and Written Opinion*", Jul. 7, 2007, 19 Pages.

* cited by examiner

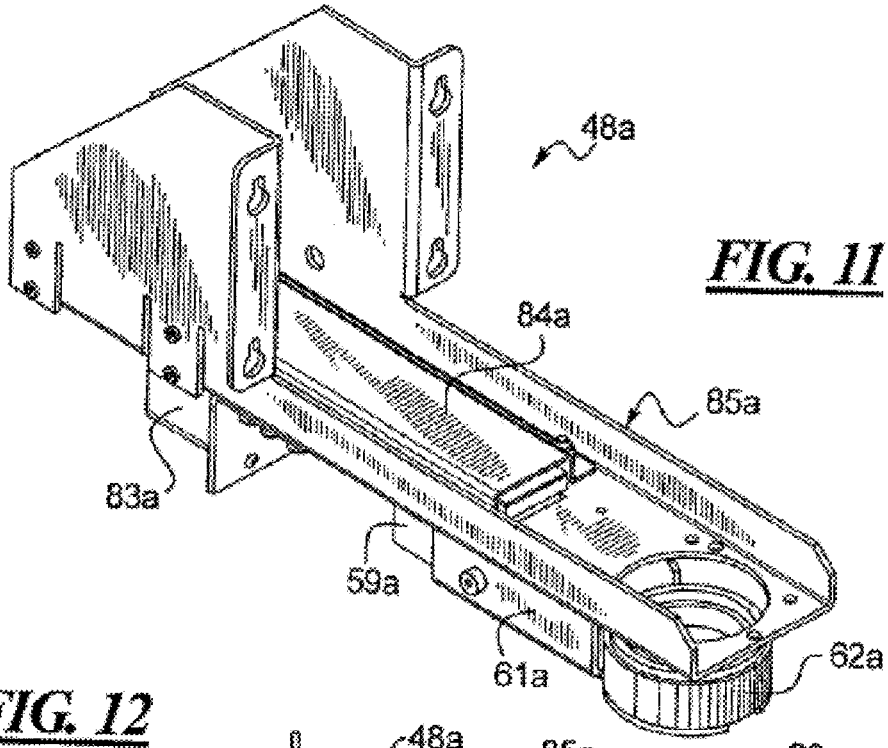
FIG. 11
FIG. 12
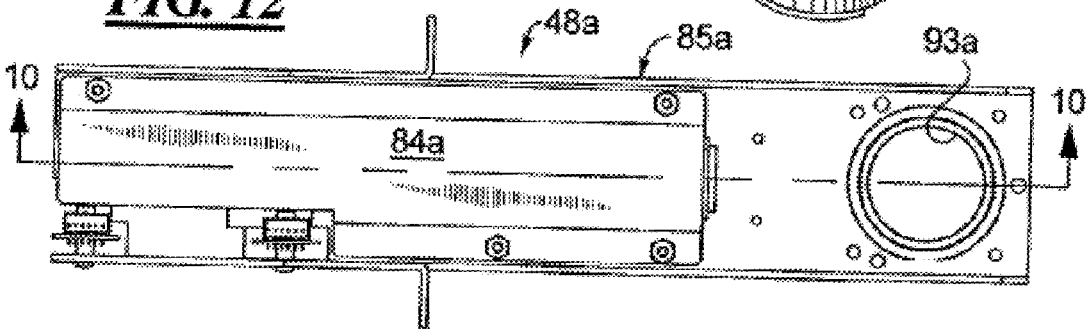
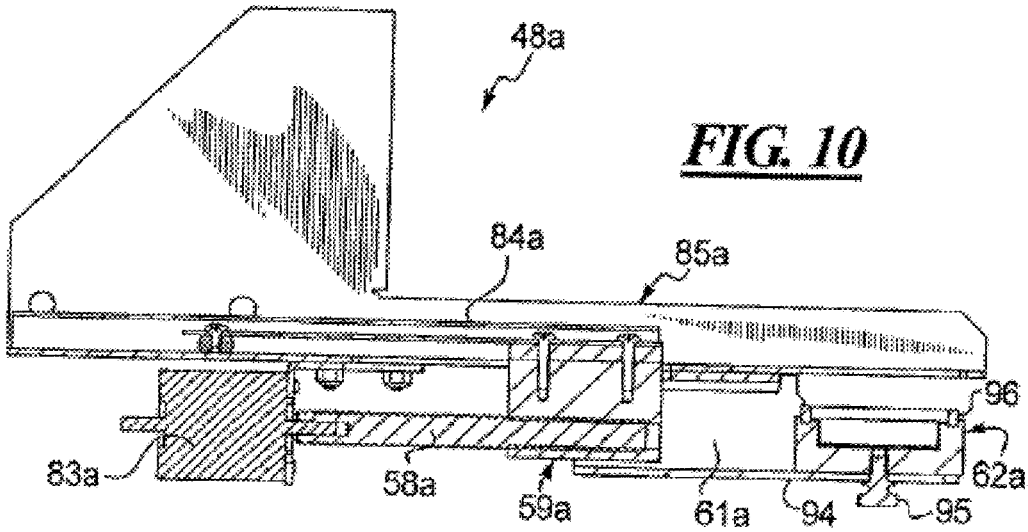
FIG. 10

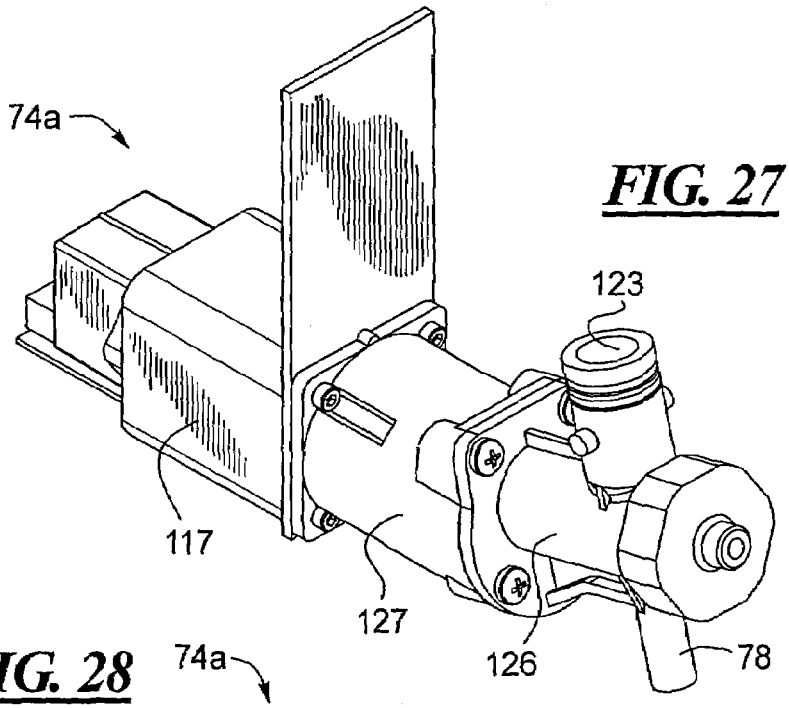
FIG. 27
FIG. 28
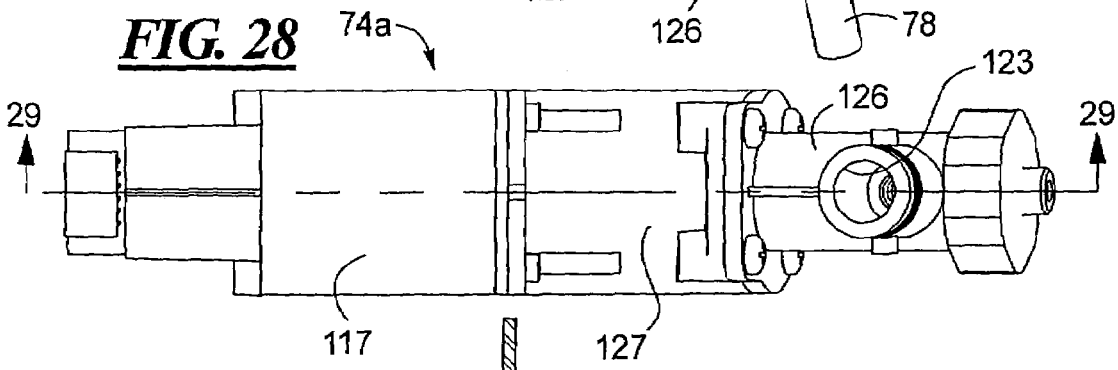
FIG. 29
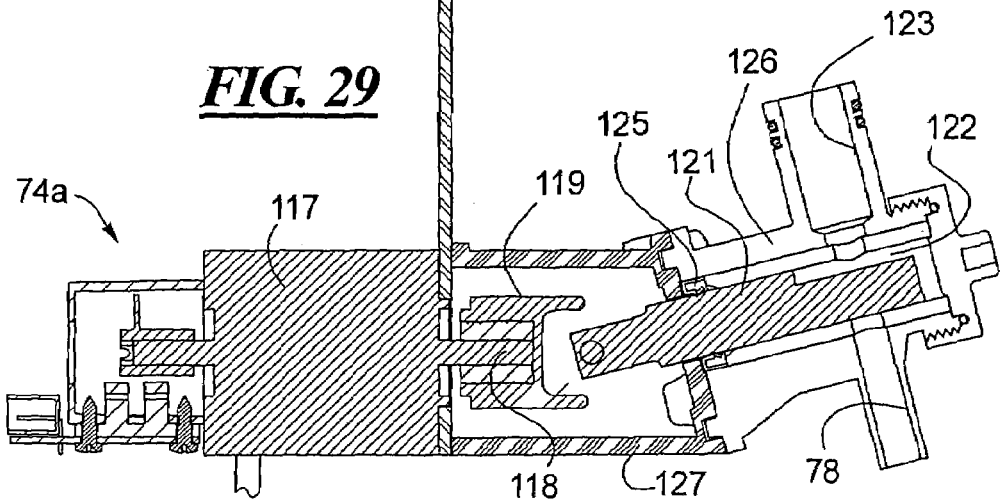

MULTIPLE FLUID DISPENSER

BACKGROUND

1. Technical Field

An apparatus is disclosed for dispensing a plurality of fluids according to one of the plurality of formulas stored in a controller. The controller is linked to a coordinating board which, in turn, is linked in series to a plurality of pump modules and a manifold module. Each pump module includes its own module board which controls the operation of two pumps associated with that module. The modules, which include the module board, two pumps and two reservoirs as well as motors for driving the pumps, are all mounted on a module frame which is detachably connected to the system so that the modules may be easily changed or replaced. Further, the manifold module may also be easily replaced. The manifold module also includes a motorized closure system.

2. Description of the Related Art

Systems for dispensing a plurality of different fluids into a container have been known and used for many years. For example, systems for dispensing paint base materials and colorants into a paint container are known. These paint systems may use twenty or more different colorants to formulate a paint mixture. Each colorant is contained in a separate canister or package and may include its own dispensing pump, e.g., see U.S. Pat. No. 6,273,298, which is commonly assigned with the present application. The colorants and the respective pumps may be disposed on a turntable or along one or more horizontal rows. In a turntable system, the turntable is rotated so that the colorant to be dispensed is moved to a position above the container being filled. In designs using one or more horizontal rows, the container may be moved laterally to the appropriate colorant/pump.

Some currently available paint colorant dispensers utilize nutating pumps and a computer control system to control the nutating pumps. Nutating pumps have a piston which is positioned inside of a housing having a fluid inlet and a fluid outlet. The piston simultaneously slides axially and rotates inside the housing. The dispense stroke or cycle can be broken down into a number of discreet steps or segments for extremely accurate volumetric dispenses. For example, a minimum dispense can be as little as 1/256 of a fluid ounce as illustrated in U.S. Pat. Nos. 6,749,402 6,540,486 and 6,398,515, all commonly assigned with the present application. These patents all disclose improved nutating pump technologies that are applicable to paint colorant dispensing as well as the dispensing of hair dyes, other cosmetics applications and other fluids.

However, as disclosed in the above patents, the software or algorithms used to accurately dispense fluids volumetrically using nutating pumps is complicated and may require frequent calibration. Further, volumetric dispensing can be slow and inaccurate if a fluid drip is retained at the end of a nozzle or manifold instead of dropping down into the container reservoir or if some of the fluid is lost to splatter. Therefore, for at least some applications, dispensing by weight or gravimetric dispensing may be preferred because the amount of fluid that actually makes it into the container is recorded as opposed to the fluid that is dispensed from the pump, some of which may be lost.

Systems for dispensing large varieties of different fluids are not limited to paints, but also include systems for dispensing pharmaceutical products, hair dye formulas, cosmetics or all kinds, nail polish, etc. Smaller systems for use in preparing products at a point of sale may use a stationary manifold through which a plurality of nozzles extend. Each fluid to be dispensed is then pumped through its individual nozzle. Depending upon the size of the container and the quantity of the fluids to be dispensed, manifolds must be designed in a space efficient manner so that a single manifold can accommodate twenty or more different nozzles. The nozzles are connected to the various ingredients by flexible hoses and the ingredients are contained in stationary canisters or containers.

For example, EP 0 443 741 discloses a formulation machine for preparing cosmetically functional products. The machine includes a plurality of containers for storing various cosmetic ingredients. An input mechanism is provided for entering into a computer specific criteria representative of a customer's needs. A series of instruction sets are then sent from the computer in response to the specific input criteria to a dispensing mechanism.

U.S. Pat. No. 4,871,262 describes an automatic cosmetic dispensing system for blending selected additives into a cosmetic base. A similar system is described in German Patent No. 41 10 299 with the further element of a facial sensor.

Other systems involve a skin analyzer for reading skin properties, a programmable device receiving the reading and correlating same with a foundation formula, and a formulation machine. Components of the formula held in a series of reservoirs within the machine are dosed into a receiving bottle and blended therein. These systems are described in U.S. Pat. Nos. 5,622,692 and 5,785,960. Because the systems disclosed in the '692 and '960 patents suffer from relatively poor precision, nutating pump technology was applied to improve the precision of the system as set forth in U.S. Pat. No. 6,510,366.

In such multiple fluid dispensing applications, both precision and speed are essential. Precision is essential as many formulations require the addition of precise amounts of ingredients. This is true in the pharmaceutical, cosmetic and paint industries as the addition of more or less of a key ingredient can result in a visible change in the color or product or the efficacy of a product.

Speed is important as many products are prepared at a point-of-sale for a customer. For example, paint formulations, cosmetic formulations, hair dyes and various nutritional products are all being prepared in retail environments while the consumer waits. Typically, such systems include the customer selecting a formulation from a list and that has been stored in a computer memory and an automated machine is used to prepare the formulation. Dispensing one ingredient at a time is a slow process and when more than a few consumers are waiting to use a machine, they may be discouraged and wish to take their business elsewhere.

One way in which the precision of dispensing systems is compromised is "dripping." Specifically, a "leftover" drip may be hanging from a nozzle that was intended to be added to a previous formulation and, with a new container in place under the nozzle, the drop of liquid intended for a previous formulation may be erroneously added to a new formulation. Thus, the previous container may not receive the desired amount of the liquid ingredient and the next container may receive too much.

To solve the drip problem, various scraper and wiper designs have been proposed. However, these designs often require one or more different motors to operate the wiper element and are limited to use on dispensing systems where the nozzles are separated or not bundled together in a manifold. Use of a wiper or scraping function would not be practical in a multiple nozzle manifold design as the ingredients from the different nozzles will be co-mingled by the wiper or scraper which would then also contribute to the lack of precision of subsequently produced formulations.

Another problem associated with dispensing systems that make use of nozzles lies in the dispensing of relatively viscous liquids such as tints, colorants, base materials for cosmetic products, certain pharmaceutical ingredients or other fluid materials having relatively high viscosities. Specifically, the viscous fluids have a tendency to dry and cake onto the end of the nozzles, thereby requiring frequent cleaning in order for the nozzles to operate effectively. While some mechanical wiping or scrapping devices are available, these devices are not practical for multiple nozzle manifold systems and the scraper or wiper element must be manually cleaned anyway.

One solution would be to find a way to provide an enclosing seal around the nozzle or manifold after the dispensing operation is complete. In this manner, the viscous materials being dispensed through the nozzles would have less exposure to air thereby requiring a lower frequency of cleaning operations. To date, applicants are not aware of any attempts to provide any sort of nozzle or manifold closure or sealing element that would protect against drips as well as reducing the frequency in which the nozzle or manifolds must be cleaned.

Another problem associated with the machines described above, is the relative inflexibility of their design. Specifically, machines are either designed for dispensing fluids contained in cylindrical canisters or flexible bags. While some machines may dispense smaller amounts of materials such as tints or colorants from flexible bags and larger quantities of base material or solvent from rigid containers, no currently available machine is able to be easily adapted in the event the packaging for a raw material or an ingredient changes from a bag to a rigid container or vice versa. In short, currently available systems are not easy to modify or adapt to different uses or for dispensing different materials. What is needed is an improved multiple fluid dispensing whereby the pumps, reservoirs containing the fluids to be dispensed, motors and manifolds may be easily changed or replaced so that the machine may be adapted for changing consumer demands.

Accordingly, with the above problems in mind, there is a need for an improved multiple fluid dispensing system that is fast, efficient, that may be easily adapted or modified and that provides an improved cover or drip catcher for the manifold or fluid outlets.

SUMMARY OF THE DISCLOSURE

In satisfaction of the aforenoted needs, an improved dispenser for dispensing a plurality of different fluids is shown and described. One disclosed dispenser comprises a controller that is linked to a coordinator board. The controller has a memory with a plurality of recipes stored therein. The controller board is linked to a first module. The first module is linked in a series to a plurality of other modules. Each module comprises a module board. Each module board is linked to at least one pump. Each pump is then linked between its own reservoir fluid to be dispensed and its own outlet nozzle. The controller, controller board and module boards are all programmed for the simultaneous or sequential pumping of multiple fluids from the reservoirs and through the outlet nozzles in accordance with a recipe selected by the user and retrieved from the memory of the controller.

In a refinement, each module further comprises a module frame for supporting its respective module board. Each module board is linked to a pair of pumps that are both supported by the module frame. The module frame also supports each pair of reservoirs linked to the pumps and it is the module board that at least partially controls the operation of the pumps as opposed to the controller or coordinator board. Thus, the disclosed dispenser has a decentralized and modular control system.

In another refinement, the disclosed system comprises housing cabinetry designed in such a way that each module is detachably connected to the cabinetry so that each module may be easily exchanged or replaced. Further, the cabinetry is also preferably designed so that additional modules may be added easily.

In a further refinement of this concept, the disclosed dispenser comprises from 6 to 16 modules for simultaneous dispensing of from 12 to 32 different fluids. In other embodiments, less than 12 different fluids may be dispensed and more than 32 fluids may be dispensed.

In another refinement, each pump is connected to its respective outlet nozzle by a flexible hose and each outlet nozzle is mounted within a manifold block. In a further refinement, the manifold block is supported within a manifold housing which is also modular in design and which may be detachably connected to the cabinetry.

In a further refinement of this concept, each outlet nozzle is connected to an inlet end of the manifold block which further comprises an outlet end. The outlet end faces downward. In a further refinement, the manifold housing also is connected to a closure mechanism for the outlet end of the manifold block. The closure mechanism comprises a motor linked to a manifold board which, in turn, is linked in series to the various modules.

In a further refinement, the closure mechanism comprises a supporting frame connected to a motor. The motor is connected to a threaded drive shaft. The drive shaft is directed towards the outlet end of the manifold block. The drive shaft is threadably coupled to a slide block. The slide block is slidably supported by the supporting frame. The slide block is also pivotally connected to a bracket. The bracket is connected to an upwardly facing drip catcher. The bracket comprises a catch for engaging an abutment that pivots the bracket and drip catcher upward towards the outlet end of the manifold block as the drip catcher and bracket approach the manifold block when the drive shaft is rotated to move the slide block, bracket and drip catcher towards the manifold block.

In a further refinement of this concept, the abutment is disposed on the underside of the supporting frame.

In another refinement, the drip catcher comprises an upwardly facing rim that can sealingly engage the outlet end of the manifold block.

In a different refinement, in the reservoir at least one module comprises a vertical canister while the reservoir at least one other module comprises a flexible bag. In a further refinement, one module may include a pair of vertical canisters and another module may include a pair of flexible bags.

Because of the modular design, the pumps of the various modules may be different from that of the other modules. Therefore, the pumps of the various modules may be selected from the group consisting of nutating pumps, gear pumps, piston pumps and combinations thereof as the pump of one module may be different from the pump of another module. Or, for modules designed with a pair of pumps, the pair of pumps of one module may be different from the pair of pumps of another module. In still a further, albeit less preferred refinement, a single module may include two different types of pumps and two different types of reservoirs.

In a different refinement, when a vertical hard-shell reservoir is utilized, such a reservoir may be designed so that an upper portion of the vertical reservoir has a square cross-section and a lower portion of the reservoir has a round cross-section. The upper square cross-section provides larger volumes when two reservoirs are supported next to each other and the lower round cross-section enables the reservoir to be more efficiently drained so that less fluid is wasted.

The closure system described above may also be utilized on different fluid dispensers.

The disclosed dispenser can be designed for simultaneously dispensing a plurality of fluids for a faster dispense.

BRIEF DESCRIPTION OF THE DRAWINGS

For a more completer understanding of this disclosure, reference should now be made to the embodiments illustrated in greater detail in the accompanying drawings, wherein:

FIG. 10 is a side sectional view of the closure mechanism taken along line 10-10 of FIG. 12;

FIG. 11 is a perspective view of the closure mechanism shown in FIGS. 9 and 10;

FIG. 12 is a top plan view of the closure mechanism shown in FIGS. 9-11;

FIG. 27 is a perspective view of a nutating pump that can be used with the disclosed dispensing system;

FIG. 28 is a top plan view of the pump shown in FIG. 27;

FIG. 29 is a sectional view taken substantially along the line 29-29 of FIG. 28.

It should be understood that the drawings are not necessarily to scale and that the embodiments are often illustrated by graphic symbols, phantom lines, diagrammatic representations and fragmentary views. In certain instances, details have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Figure 1:
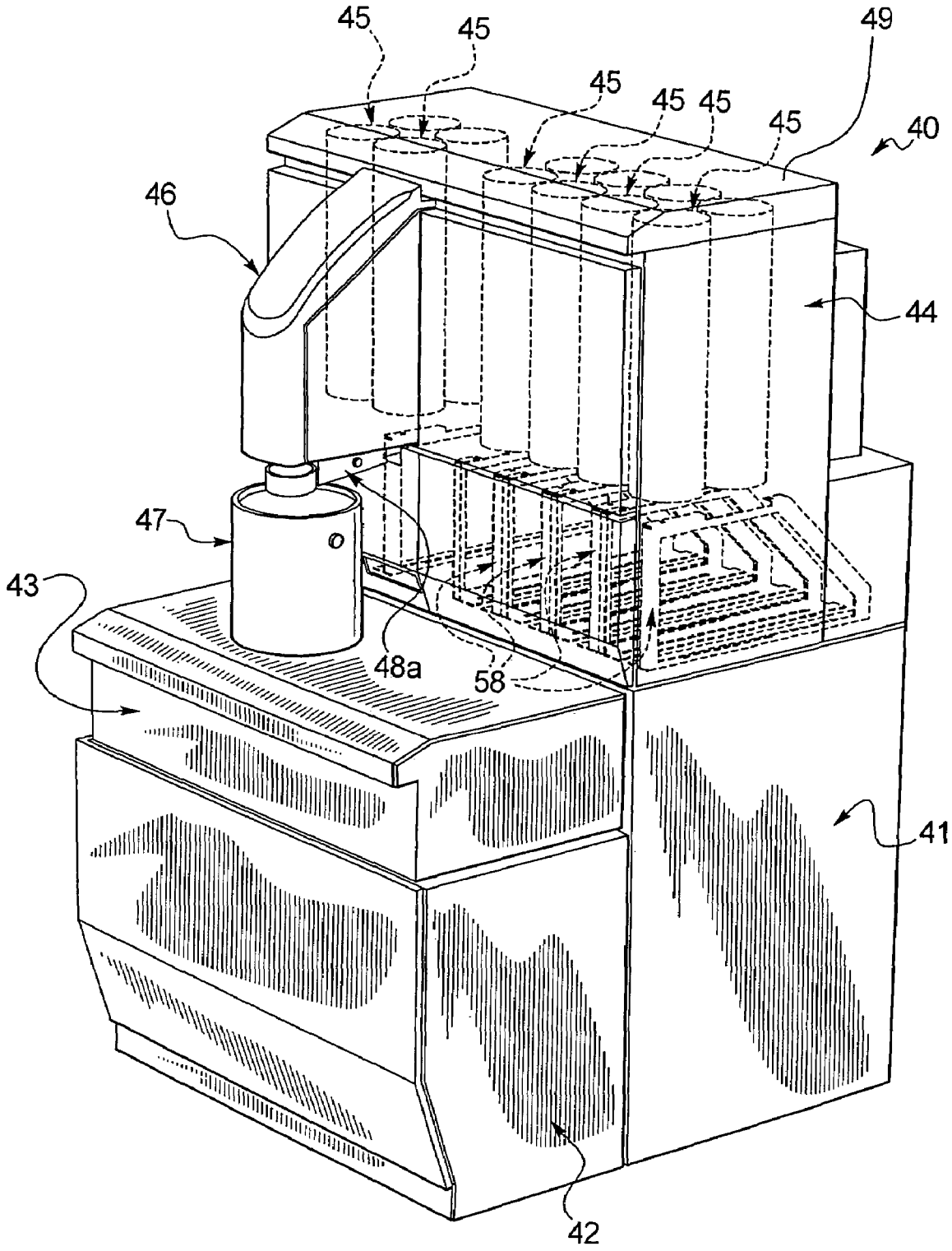
FIG. 1 is perspective view of a disclosed fluid dispensing apparatus.

FIG. 1 discloses a dispensing apparatus 40 which includes a lower base portion 41 connected to a front cabinet 42 which, in turn, is disposed beneath in support a middle cabinet shown at 43. The middle cabinet 43 may also include a scale or weighing function (not shown). Any one of the cabinets 41 through 43 may house a controller and other electronic equipment (not shown). The cabinet 41 supports an upper cabinet 44 which, in turn, houses a plurality of modules which are represented by pairs of canisters shown generally at 45. In the examples shown in FIG. 1, six modules that each dispense two different fluids are shown for a total dispending of 12 different fluids. FIG. 1 also illustrates a manifold module 46 which will be described below. The sequential or, preferably simultaneous dispensing of one or more fluids from the 12 difference fluids provided in FIG. 1 is made through the manifold module 46 and down into the container 47. A manifold closure system is shown at 48*a*.

Figure 2:
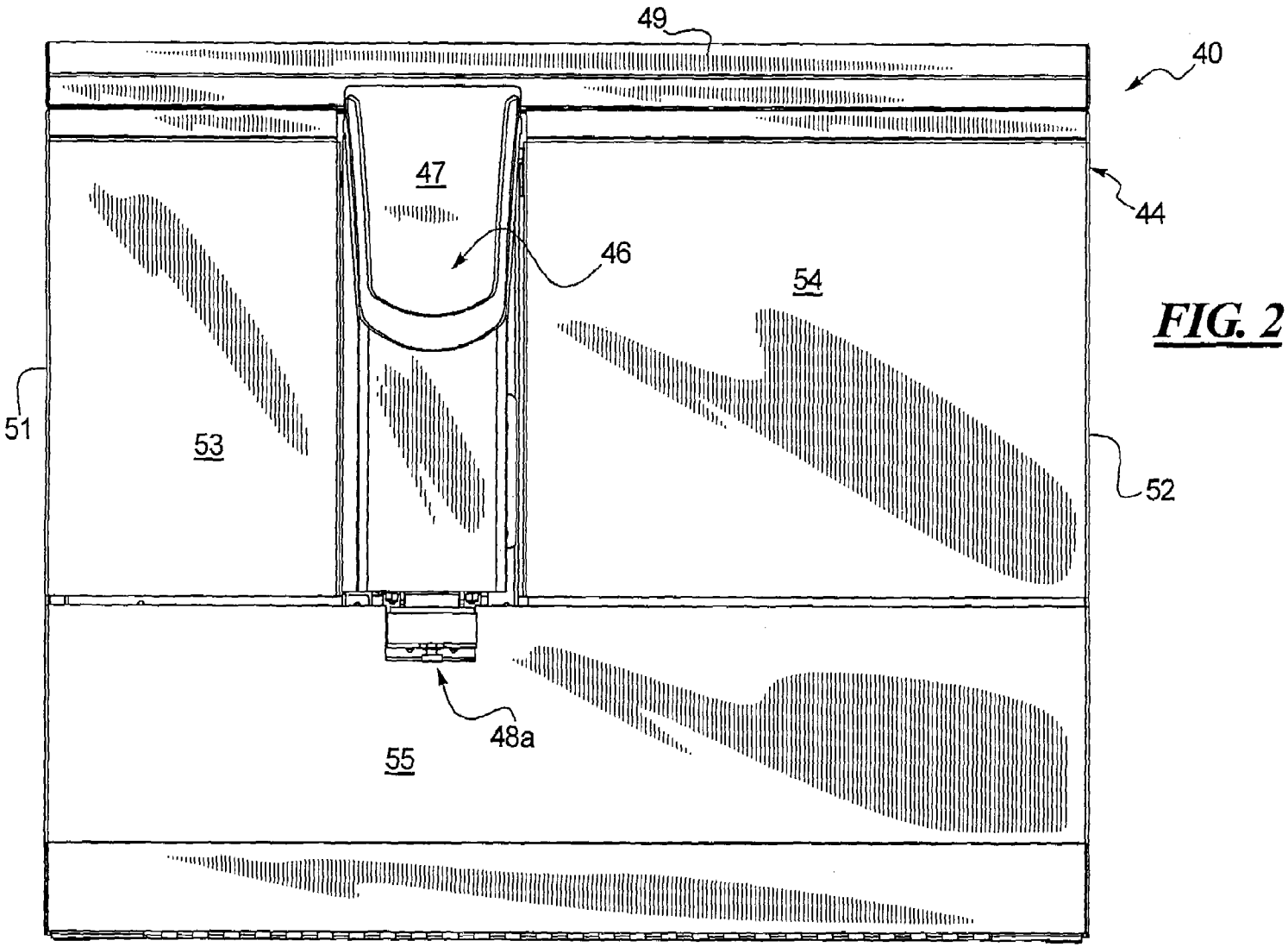
FIG. 2 is a front plan view of the fluid dispensing apparatus shown in FIG. 1.
Figure 3:
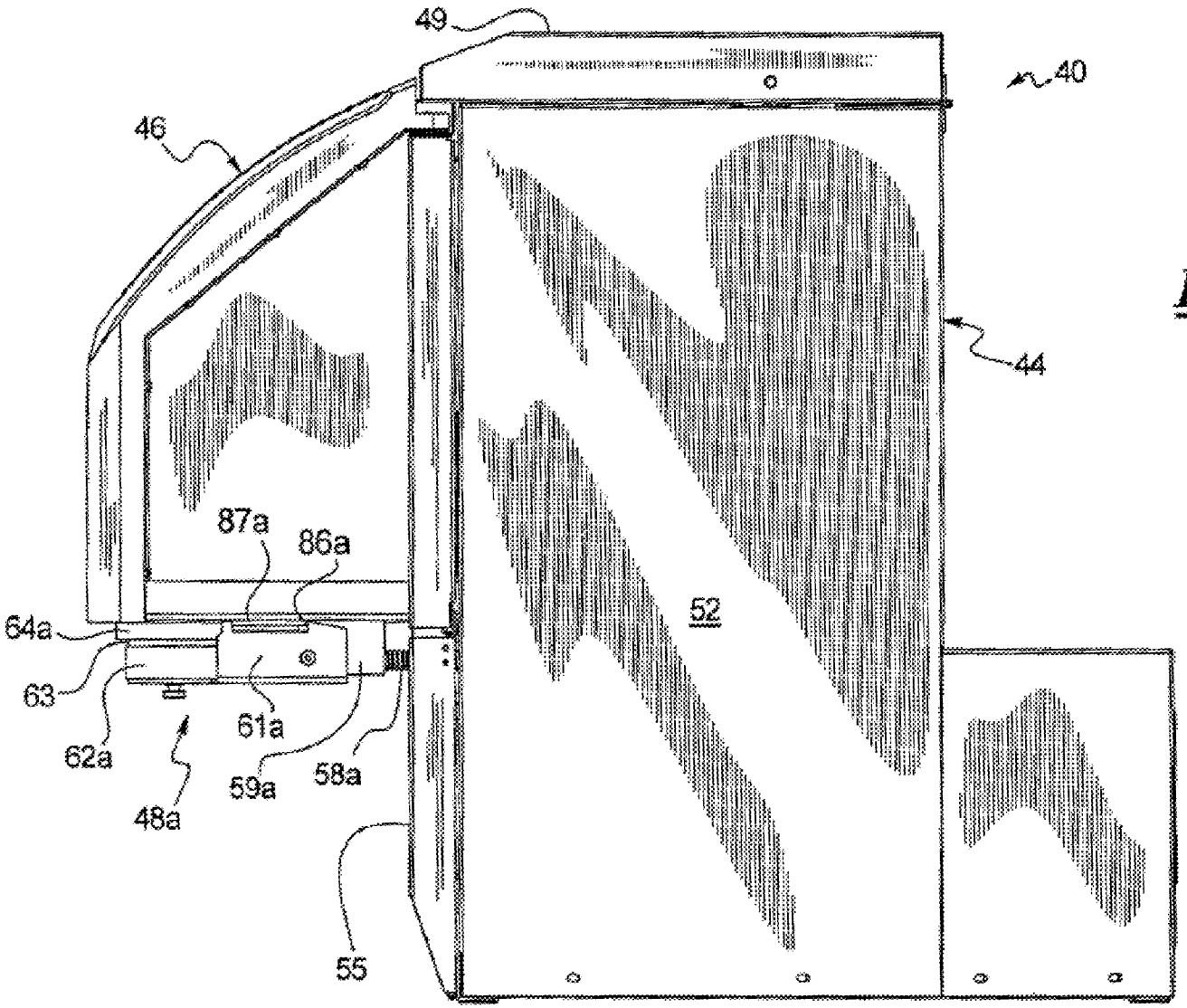
FIG. 3 is a right side elevation view of the fluid dispensing apparatus shown in FIGS. 1 and 2.

Turning to FIGS. 2 and 3, the upper cabinet 44 includes a cover 49 as well as side panels 51, 52. The cabinetry 44 also includes separate front panels 53, 54 which serve as esthetic covers for the modules shown in FIG. 1. Lower panel 55 provides access to the module brackets and related components shown at 58 in FIG. 1. The cabinet 44 is designed so that the manifold module 46 may be easily removed and replaced. The manifold module 46 includes a housing 47 and side supporting brackets as shown in FIG. 3. Also shown in FIG. 3 is the manifold closure mechanism 48*a* which will be described in greater detail below. However, it will be noted that the mechanism 48*a* includes a threaded drive shaft 58*a*, slide lock 59*a*, a bracket 61*a* and a drip catcher 62*a*. The drip catcher 62*a* may include a resilient ring 63 for sealingly engaging the manifold block 64*a*. The intricacies of the closure mechanism 48*a* will be described in greater detail below in connection with FIGS. 9-13 and an alternative embodiment 48*b* will be described in connection with FIGS. 14-16.

Figure 4:
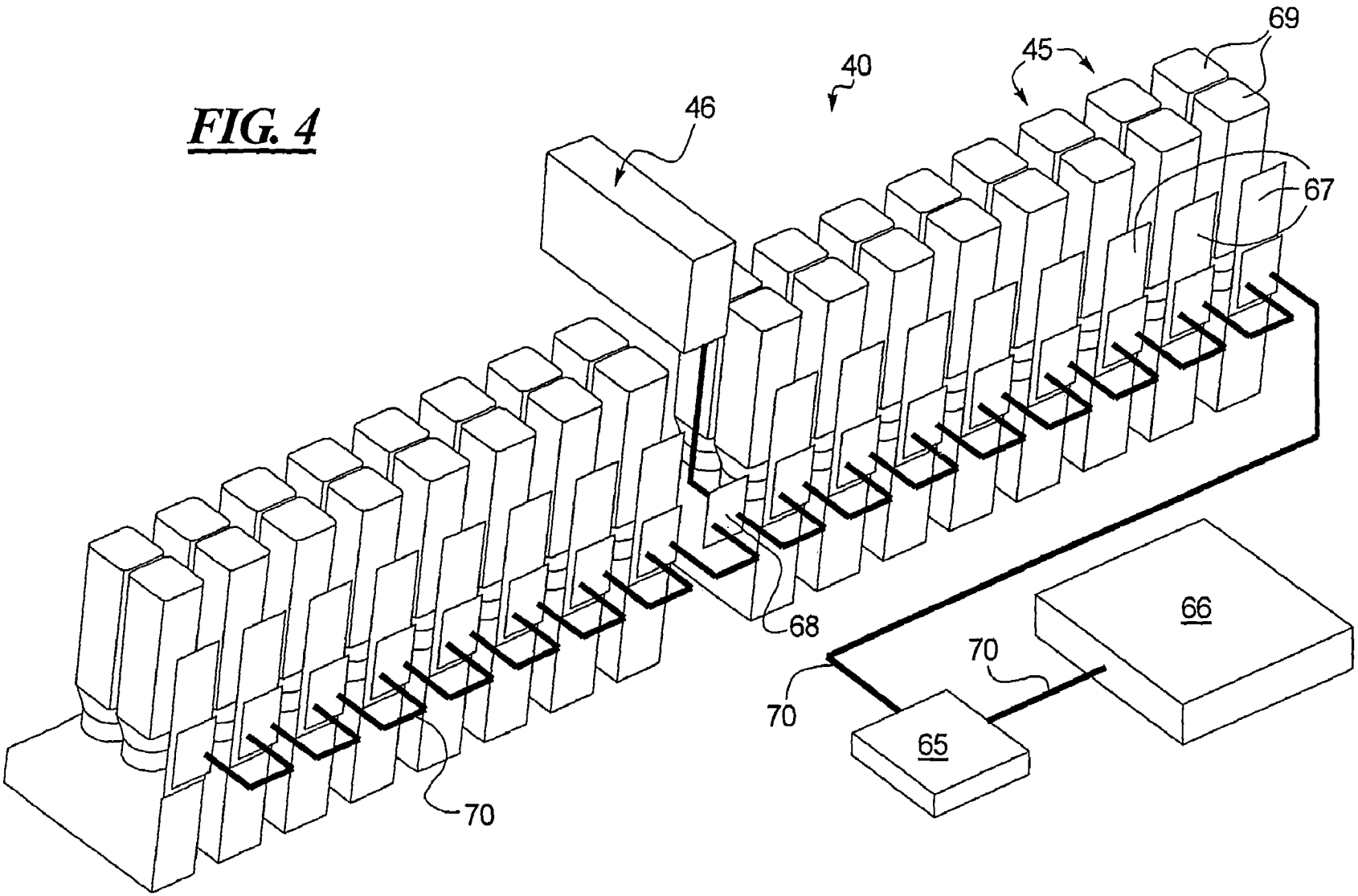
FIG. 4 is a schematic perspective view of sixteen two-pump, two-reservoir modules linked together in series with a coordinator board, controller and manifold in accordance with this disclosure.

FIG. 4 is a schematic illustration of the dispense system 40 showing 16 different modules 45 with two pumps and two reservoirs each along with a manifold module 46, all connected in series to a coordinator board 65 and a controller 66. In the modular design shown in FIG. 4, three different boards are utilized; the coordinator board 65, the module boards 67 and the manifold board 68. The main function of the manifold board 68 is to operate the manifold closure mechanism 48*a* (see FIGS. 1-3). The coordinator board 65 is the link between the PC or controller 66 and the module boards 67. The module boards 67, in the embodiment shown in FIG. 4, control two motors for pumping fluids from the pair of reservoirs of each module. Thus, each module 45 includes two reservoirs 69 and two pumps (not shown in FIG. 4) with each pump being assigned to its own reservoir 69.

The boards 65, 67 and 68 are preferably designed to share a certain common features. Such common features include the use of a common microchip series processor (e.g., a PIC18F processor), an on board power supply, a silicon serial number chip, and SIM (subscriber identify module) card socket, a stepper motor driver chip, an encoder, a DAC (digital to analog converter) chip, a CAN (controller area network) bus (preferably with RJ12 connectors), indicator LEDs (light emitting diodes), a serial debug connector and a reset switch with remote reset capability.

More specifically, one example of a coordinator board 65 includes a microchip PIC18LF8680 clocked at 20 MHz, a four quart USB (universal serial bus) hub with one port dedicated to the coordinator and three ports for general usage, an USB power control chip, high power ports, VDC converters, a single CAN port with termination resistor and additional separate CAN port with termination resistor in the form of microchip MCP2515, a FTDI FT245B USB chip, an external flash memory, preferably AMD AM29LV800DT chip, an external RAM (random access memory), preferably in the form of an ALLIANCE AS7C4O98A chip, a SIM card socket, a silicon serial number chip, preferably in the form of DALLAS DS2436 chip, indicator light admitting diodes, a reset switch with an optically isolated external input, an optically isolated abort switch input, a connector for a microchip ICD2 in-circuit debugger, and a serial port for program development usage. These exemplary parts, of course, may be modified or substituted for.

The module board 67, in a preferred embodiment, controls two bipolar stepping motors which will be described in greater detail below. One preferred module board 67 includes a PIC18F6680 microchip clocked at 40 MHz, VDC switching regulators, a CAN transceiver with dual CAN connectors, a SIM card socket, a silicon serial number chip, preferably in the form of DALLAS DS2436 with provisions for additional chips, two 8-bit DACs for setting the drive/run current for the stepper drives, two ALLEGRO microstepping driver chips, two quadrature encoder chips, two index interface circuits, two counters for quadrature encoder chips, indicator light admitting diodes, a reset switch with optically isolated external input, a connector for a ICD2 microchip in dash circuit debugger, a serial port for program development usage and two optically isolated motor driver circuits with an over current fuse. These exemplary parts, of course, may be modified or substituted for.

The manifold board 68 controls a single bipolar stepping motor and other features needed to control the nozzle closure mechanism 48*a*. One exemplary manifold board 68 includes a PIC18F6680 microchip clocked at 40 MHz, VDC switching regulators, a CAN transceiver dual CAN connectors, a SIM card socket, a silicon serial number chip, preferably in the form of DALLAS DS2436 with provisions for additional chips, one or more 8-bit DACs for setting drive/run current for the stepper drive, and ALLEGRO microstepping driver chip, a quadrature encoder chip, an index interfacing circuit, counters for the quadrature encoder chip, indicator light admitting diodes, a reset switch with an optically isolated external input, a connector for a ICD2 microchip in dash circuit debugger, a serial port for development usage, dual mechanical or optical limit switch interface circuits, an optically isolated CAN sensor interface circuit and a pulsed high current LED located control. These exemplary parts, of course, may be modified or substituted for.

As shown in FIG. 4, the controller, coordinator board 65 and module board 67 of the various modules, along with the manifold board 68 of the manifold module 46 are all connected in series, using easy-to-obtain phone lines or patch cables 70.

The controller 66 includes a graphical user interface (GUI) that enables a user to select a recipe or formula and a quantity for dispensing. The controller 66 also includes an application program interface (API), an encoding/decoding program referred to as a machine control driver (MCD) which is preferably a DVX application, an interface controller (IFC) for packing commands and a communications driver for sending serial commands to the coordinator board 65, preferably through a USB port.

The coordinator board 65 receives commands from the controller 66 through a complimentary USB port. The coordinator board 65 includes its own communications driver for receiving the commands, its own IFC for unpacking the commands received from the controller 66 and its own real time operating system (RTOS) and API. Hardware devices of the coordinator board 65 also preferably include a general purpose timer, a serial number chip, a subscriber identification module (SIM), an electrically erasable programmable read only memory (EEPROM), a debug port, LED pins, a debug LED pin, and a control area network (CAN) port.

To begin dispensing, the coordinator board 65 will preferably send a message down the line of module boards 67 to stop agitating. The multiple fluid and quantity dispense message received from the PC 66 will then be parsed into individual messages, i.e. separate messages for each ingredient, and sent, preferably one at a time, down the line of modules boards 67 (and manifold board 68) as shown in FIG. 4. The individual ingredient dispense messages sent by the coordinator board 65 to the module board 67 linked to the coordinator board 65 are packaged by a protocol packaging driver as a part of a control area network (CAN), then sent by a communication driver out a CAN port to a complimentary CAN port on the module board 67.

Each module board 67 receives messages either directly from the coordinator board 65 if the module board 67 is linked to the coordinator board 65, or more often, from the preceding module board 67 in the chain, through its own CAN port. Like the coordinator board 65, module boards 67 and manifold board 68 include a general purpose timer, a serial number chip, a subscriber identification module (SIM), an electrically erasable programmable read only memory (EEPROM), a debug port, LED pins, a debug LED pin, and a control area network (CAN) port. Each board 67 also includes one or more digital to analog converter chips (DAC), stepper drive chips, sensor pins, agitation pins and other LED pins.

Each module board 67 has its own communication driver for receiving each message, a protocol packaging driver for unpacking the message and a RTOS. The identification hardware and applications of each board 67, 68 enable the board 67 or 68 to identify if the message is intended for one of its pumps or, in the case of the manifold board 68, the motor used to open or close the closure mechanism 48. When the message is intended for another board 67 or 68 down the line, the message is sent out through the CAN port.

When a message needs to be acted on by a module board 67, the a message from the protocol packaging driver is sent by the RTOS and API of the module board 67 through pump logical device application to a stepper drive driver. The stepper drive driver sends and on/off signal through a digital to analog converter (DAC) to the DAC chip, a forward signal to the stepper drive chip, and a signal indicative of the number of steps or pulses need to a discrete I/O driver. Signals are sent back to the coordinator board 65 that the operation has been completed or not completed. Agitation is preferably stopped before a dispense is commenced. The manifold board 68 is somewhat similar but simplified because it includes a stepper motor to open or close the mechanism 48*a* as described below in connection with FIGS. 9-13.

Figure 5:
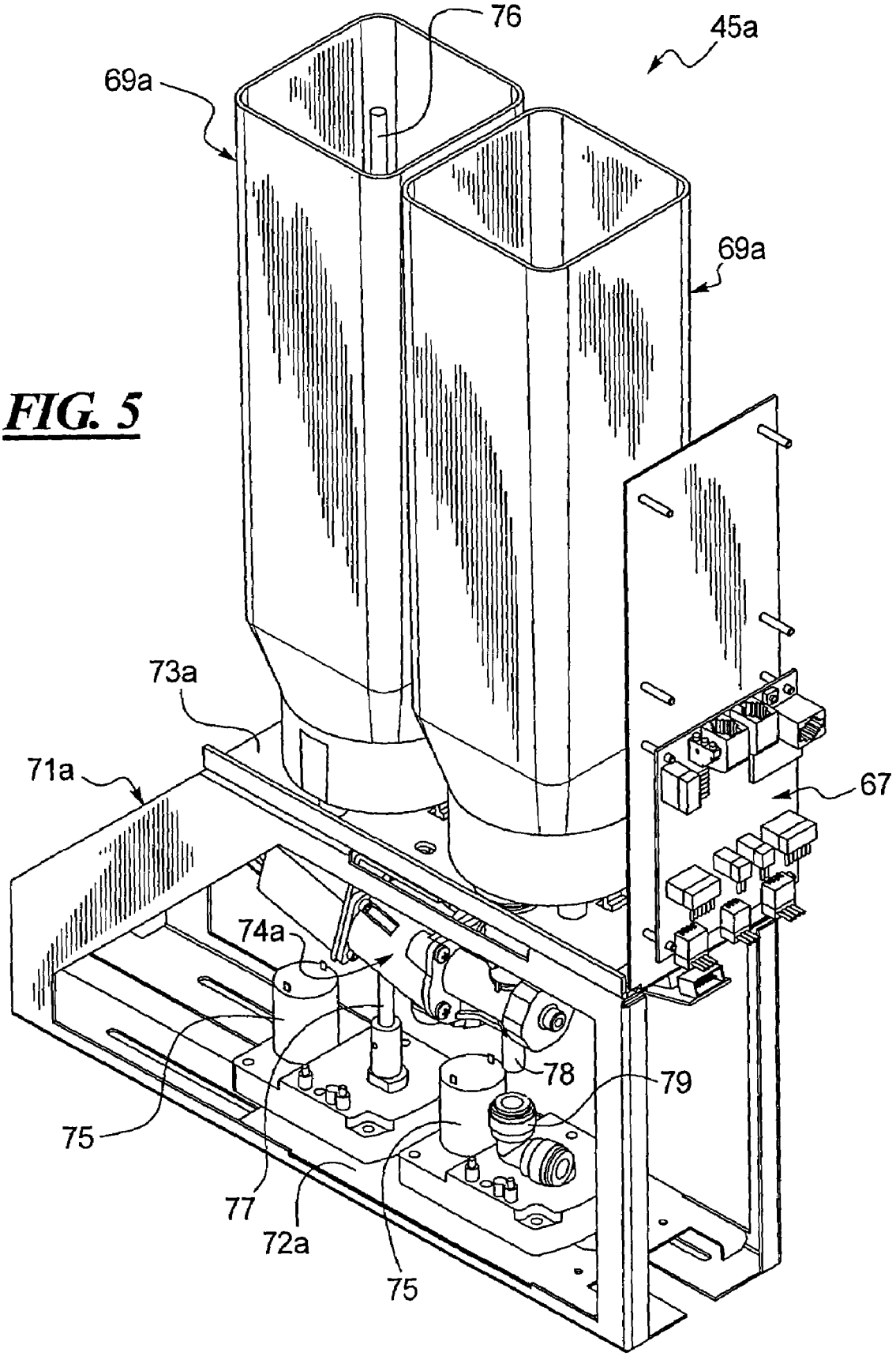
FIG. 5 is a perspective view of a module with two disclosed vertical canisters.
Figure 6:
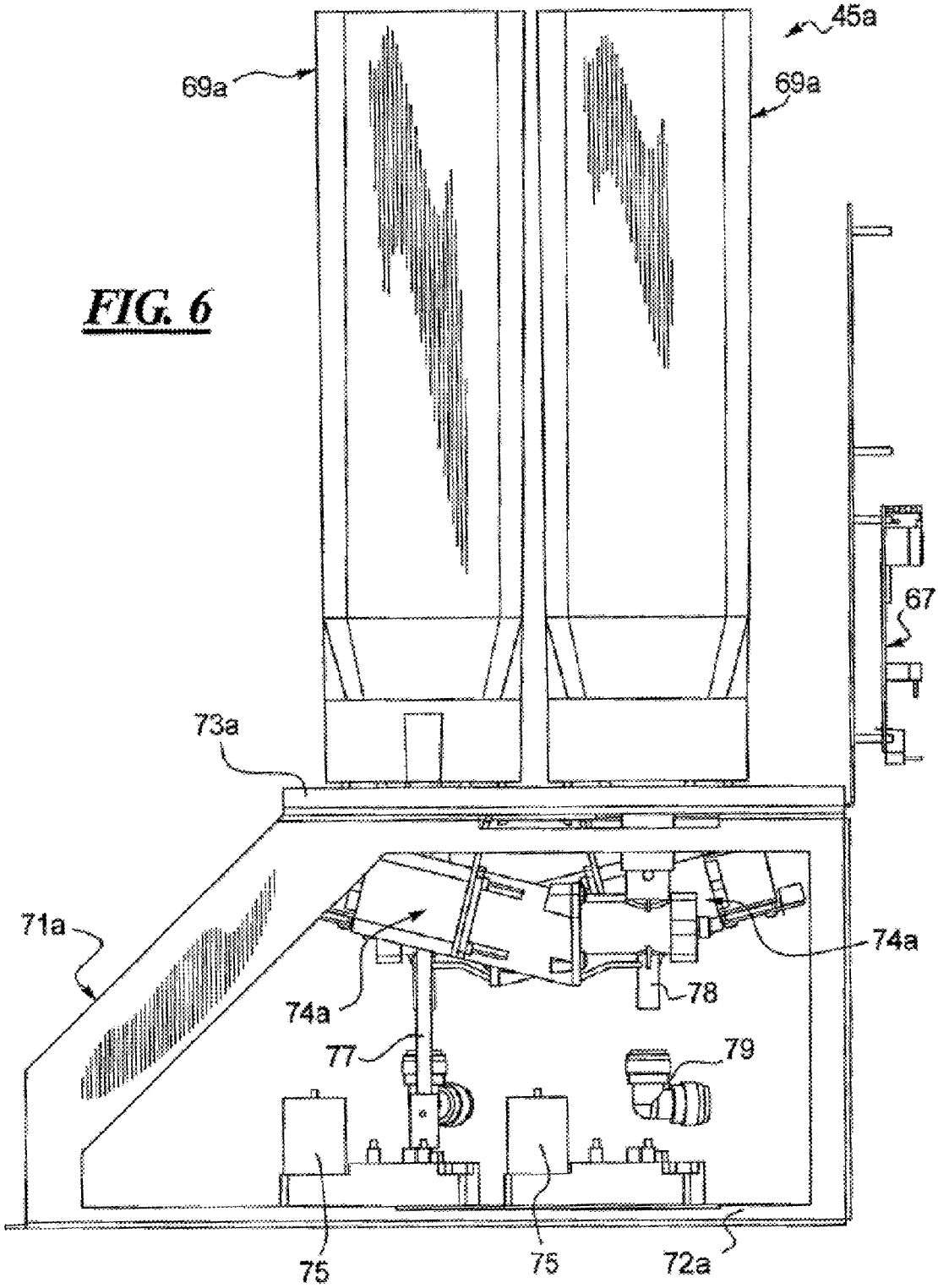
FIG. 6 is a left side plan view of the module shown in FIG. 5.

Turning to FIGS. 5 and 6, a module 45*a* is shown which includes vertical hard-shell canister 69*a* which will be further described in connection with FIGS. 20-23 below. The canisters 69*a* are supported by a module frame 71*a* which includes a lower base 72*a* that is slidably received into the upper portion of the cabinet 44 as shown in FIG. 1. The frame 71*a* also includes an upper portion 73*a* that supports the canisters 69*a* and also supports two pumps shown at 74*a* in FIGS. 5 and 6.

Each pump 74*a* is linked to one canister 69*a*. The pumps 74*a*, in turn, are linked to the manifold block 64*a* (see FIG. 3) and, the operation of each pump 74*a* is controlled by the module board shown at 67. The module board 67 may also control the motors shown at 75 which rotate the agitator paddles 76 shown in FIGS. 24 and 25. The use of the agitator paddles 76 are often needed as the fluid being dispensed from the canisters 69*a* can be very viscous and undue waste would result if the agitator paddles 76 were not utilized on a periodic or timed basis. As shown in FIGS. 5 and 6, the agitator motor 75 is linked to a drive shaft 77 which, in turn, rotates the paddle 76 (see also FIGS. 24 and 25). FIGS. 5 and 6 also illustrate an outlet 78 of a fluid pump 74*a* and an elbow nozzle 79 for connecting the outlet 78 to a hose leading to the manifold 46.

Figure 7:
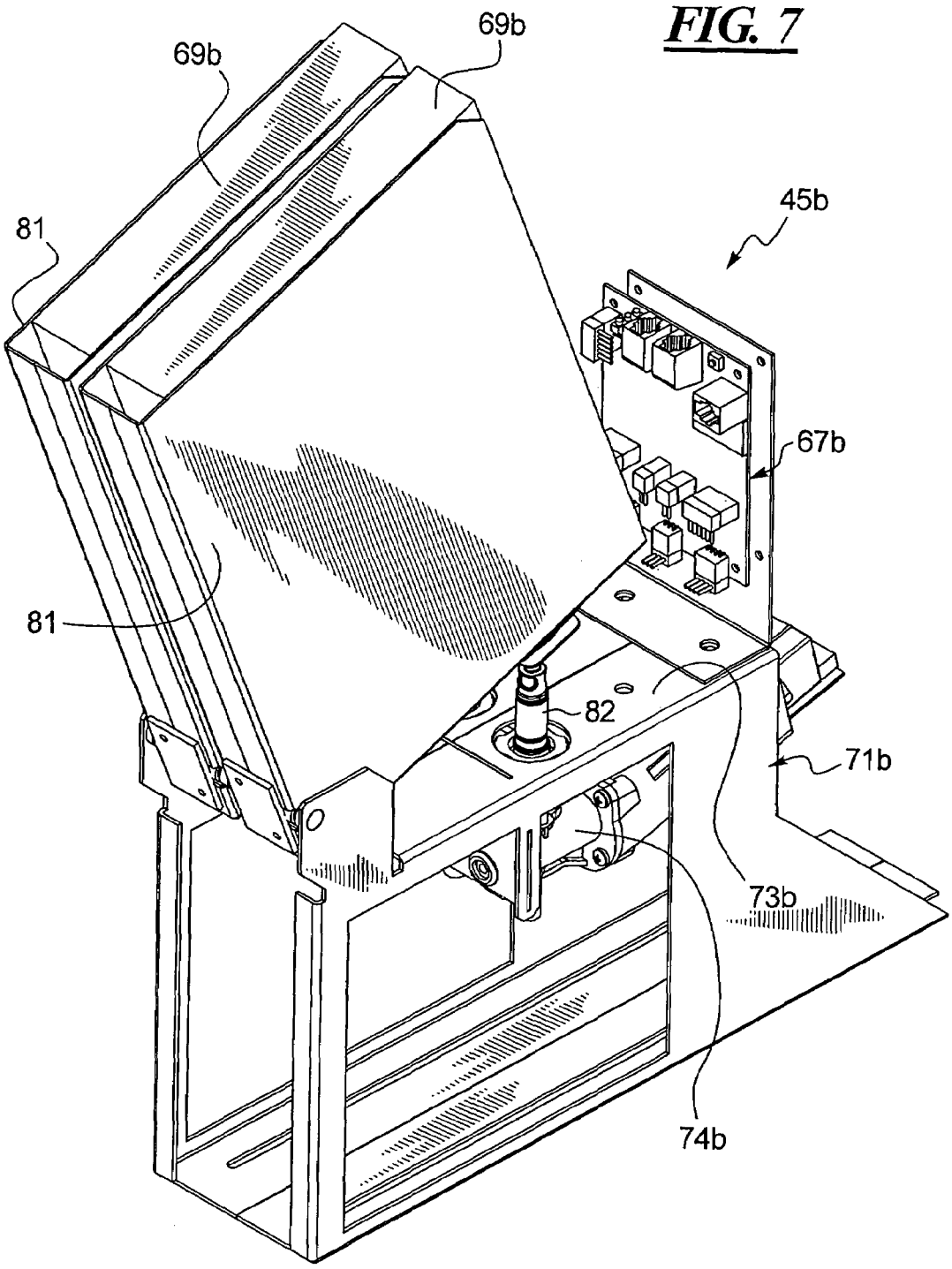
FIG. 7 is a perspective view of a module with two flexible bag reservoirs made in accordance with this disclosure.
Figure 8:
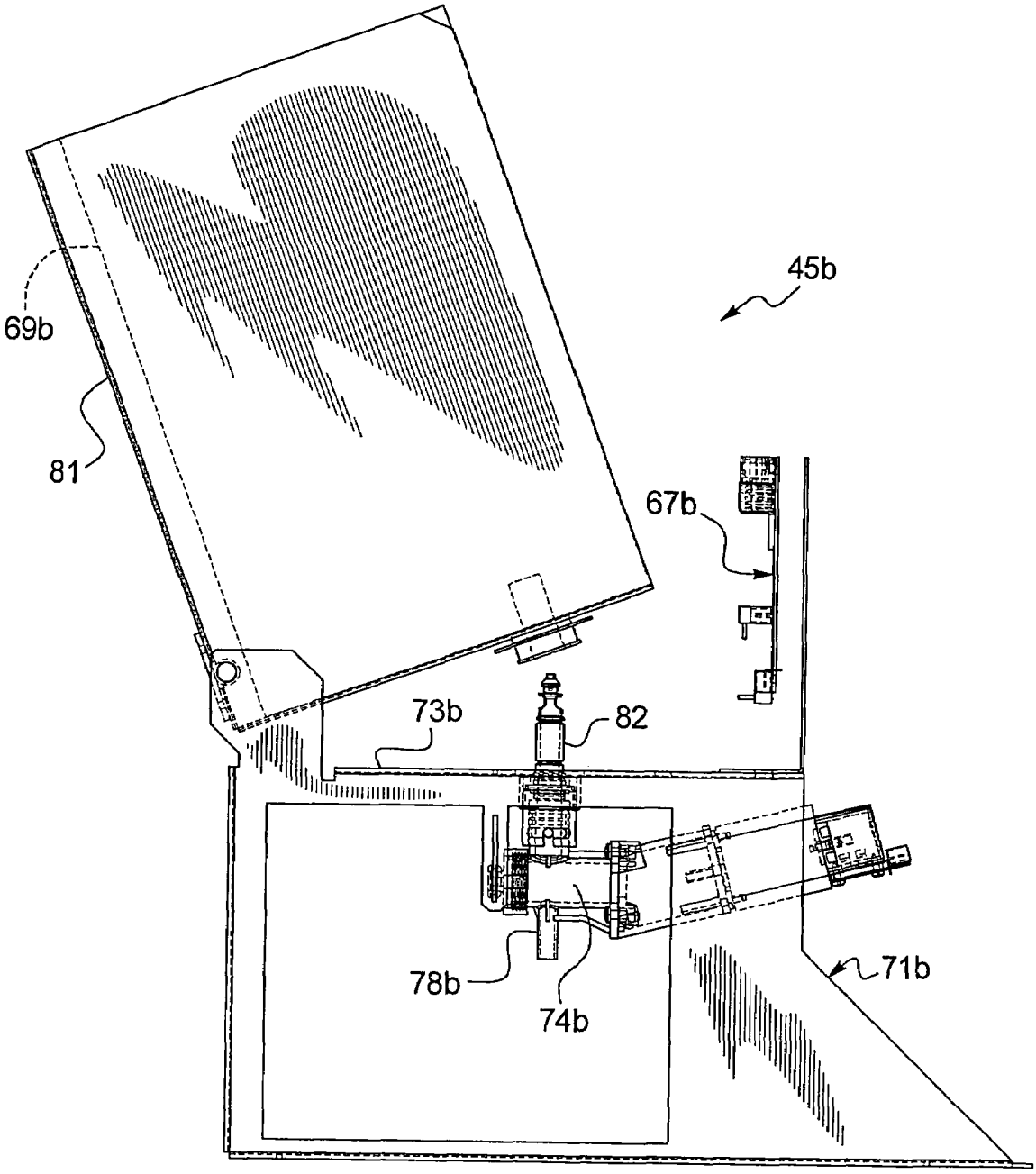
FIG. 8 is a right side elevational view of the module shown in FIG. 7.

The module 45*a* shown in FIGS. 5 and 6 are particularly suitable for upright hard-shell vertical canisters such as those shown at 69*a* in FIGS. 5 and 6. In contrast, FIGS. 8 and 7 illustrate a module 45*b* whereby the hard-shell vertical canister 69*a* has been replaced with flexible bags shown at 69*b*. The bags 69*b* are supported in sleeves 81 which, in turn, are pivotally connected to the module bracket 71*b*. The upper portion 73*b* of the bracket 71*b* also supports two pumps 74*b* which, in turn, are controlled by the module board 67*b*. The pumps 74*b* are connected to the bags 69*b* by specially designed nozzles 82 which are further illustrated below in connection with FIG. 26. The module frame 71*b* can be easily slide in and out of the cabinetry 44 of the fluid dispenser 40, in a manner similar to the module frame 71*a* illustrated in FIGS. 5 and 6. Thus, the modules 45*a* and 45*b* are interchangeable and one dispensing system 40 may include vertical canister modules 45*a* and flexible bag modules 45*b*. The module boards 67, 67*b* all communicate with each other and with the coordinator board 65.

Figure 9:
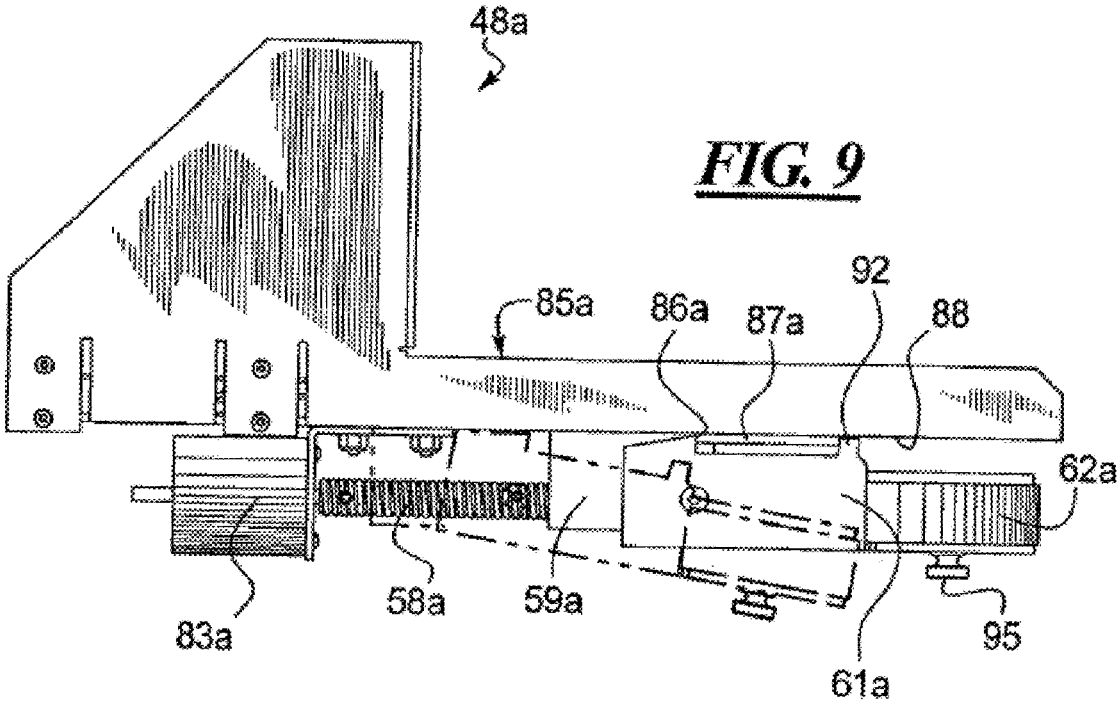
FIG. 9 is a side plan view of the closure mechanism for the manifold illustrated in part in FIGS. 1-3.
Figure 13:
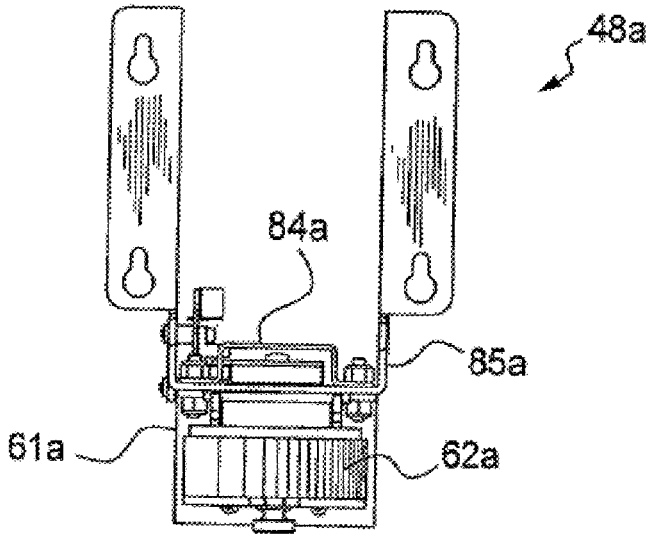
FIG. 13 is a front plan view of the closure mechanism shown in FIGS. 9-12.

Turning to FIGS. 9-13, the manifold closure mechanism 48*a* is shown and described. The closure mechanism 48*a* includes a motor 83*a* which rotates the drive shaft 58*a*. The drive shaft 58*a*, in turn, is threadably coupled to the slide block 59*a*. The slide block 59*a* is slidably supported within a track 84*a* formed in the supporting frame 85*a*. Rotation of the drive shaft 58*a* by the motor 83*a* results in movement of the slide block 59*a* along the track 84*a*. The slide block 59*a* is pivotally connected to the bracket 61*a* which, in turn, is connected to and supports the drip catcher 62*a*. Referring to FIG. 9, when the catch 86*a* of the bracket 61 a engages the abutment 87*a* disposed on the underside 88 of the supporting bracket 85*a* as shown in FIG. 9, the bracket 61*a* and drip catcher 62*a* are pivoted upward to the position in shown in solid lines in FIG. 9. When the slide block 59*a*, bracket 61*a* and drip catcher 62*a* are retracted to the left in FIG. 9, the drip catcher 62*a* and bracket 61*a* pivot downward and to the left as shown in phantom lines in FIG. 9 due to the pivotal connection between the bracket 61*a* and the slide block 59*a* at the pin. Thus, in the position shown in solid lines in FIG. 9 and in FIGS. 10 and 11, the motor 83*a* has rotated the drive shaft 58*a* so that the slide block 59*a* has traversed to the right along the track as shown in FIG. 9 so that the catch 86*a* of the bracket 61*a* has engaged the abutment 87*a* thereby pivoting the bracket 61*a* and drip catcher 62*a* upward to the position shown in solid lines in FIG. 9 as well as in FIGS. 10 and 11. The tab 92 of the bracket 61*a* serves as a stop for limiting the upward pivotal movement of the bracket 61*a* and drip catcher 62*a* as the tab 92 engages the underside 88 of the supporting bracket 85*a*.

As shown in FIG. 12, the bracket 85*a* includes an opening 93*a* for accommodating the manifold block 64*a* discussed below in connection with FIGS. 17-19. The drip catcher 62*a* is also threadably connected to the underside 94 of the bracket 59*a* by way of the threaded fastener 95 which enables the drip catcher 62*a* to be easily removed and cleaned. Further, the drip catcher 62*a* includes a resilient ring 96 for sealingly engage the manifold block 64*a* (see FIG. 3) and FIGS. 17-19.

Figure 14:
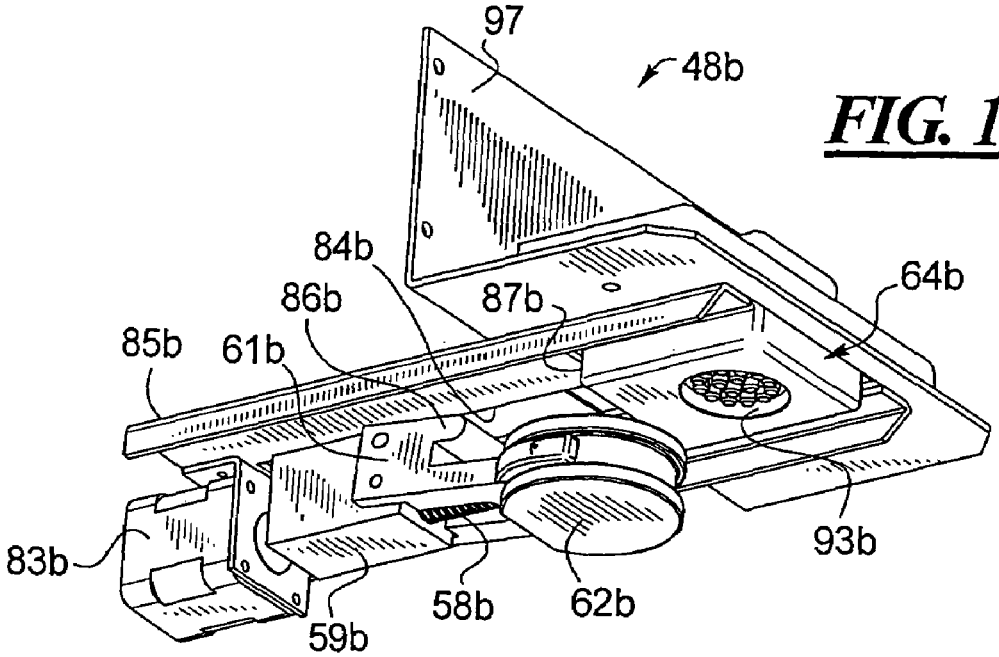
FIG. 14 is a perspective view of an alternative embodiment of a closure mechanism.
Figure 15:
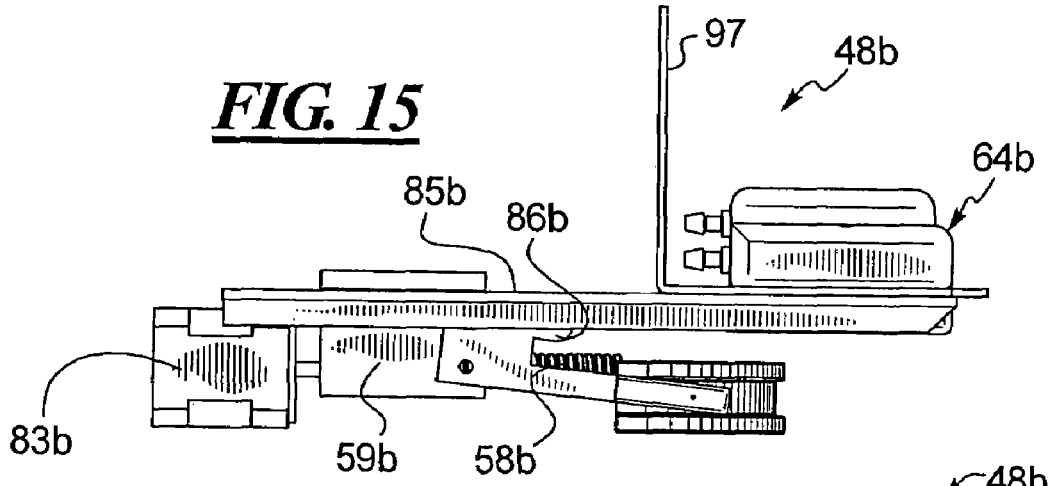
FIG. 15 is a side plan view of the closure mechanism shown in FIG. 14.
Figure 16:
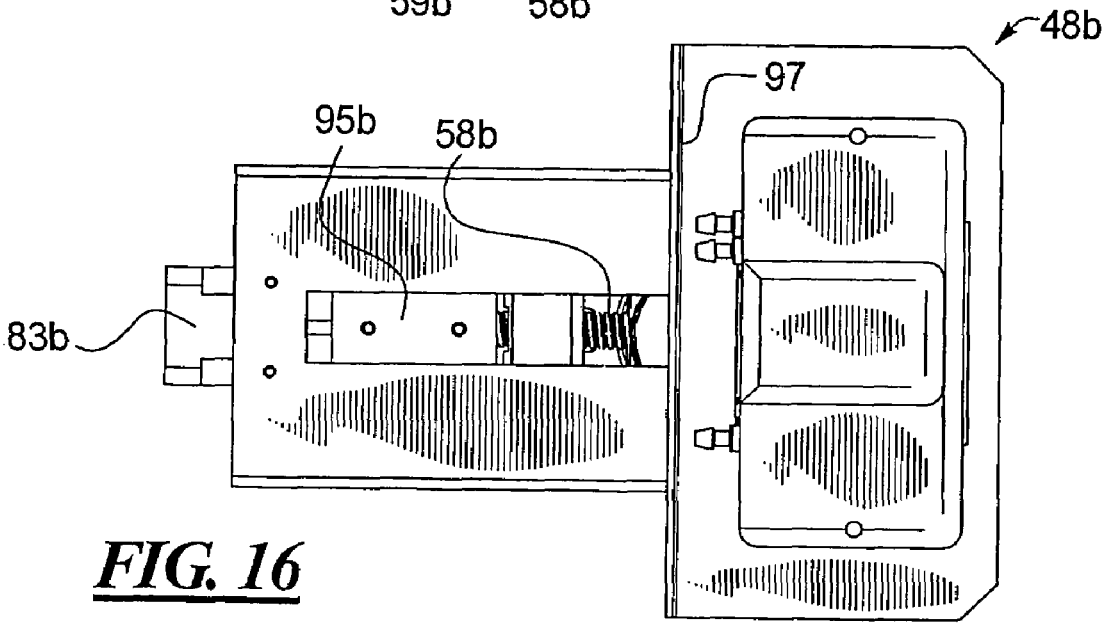
FIG. 16 is a top plan view of the closure mechanism shown in FIGS. 14 and 15.

An alternative manifold closure mechanism 48*b* is illustrated in FIGS. 14-16. The mechanism 48*b* includes a bracket 97 for mounting to the manifold module 46. An alternative embodiment of a manifold block is shown at 64*b*. A motor 83*b* rotates a drive shaft 58*b* which, in turn, moves a slide block 59*b* towards the manifold 64*b*. The slide block 59*b* is pivotally connected to the drip catcher 62*b* by way of the bracket 61*b*. The bracket 61*b* includes a rounded catch 86*b* that engages the rear wall 87*b* of the manifold 64*b* and pivots the drip catcher 62*b* upward in a manner similar to that of the closure mechanism 48*a* illustrated in FIGS. 9-13 above.

Figure 17:
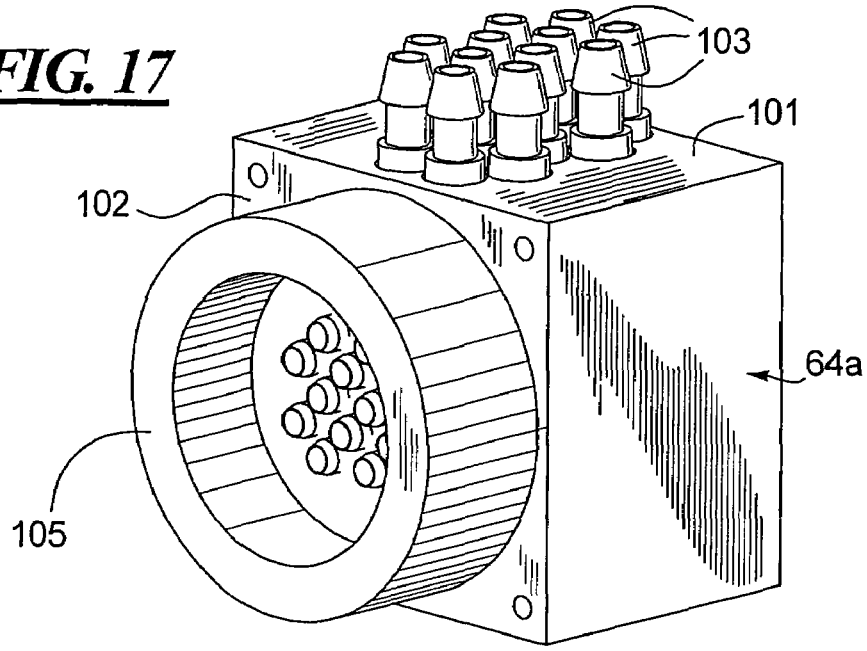
FIG. 17 is a perspective view of a manifold for use in the disclosed fluid dispenser.
Figure 18:
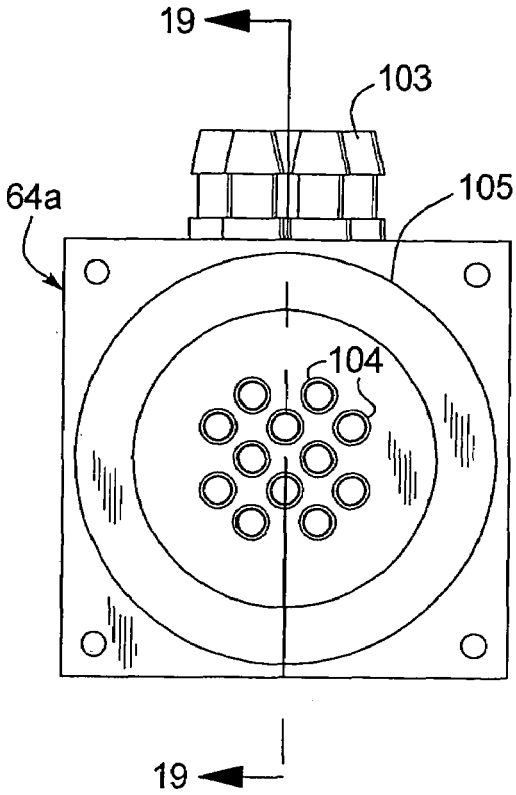
FIG. 18 is a bottom plan view of the manifold shown in FIG. 17.
Figure 19:
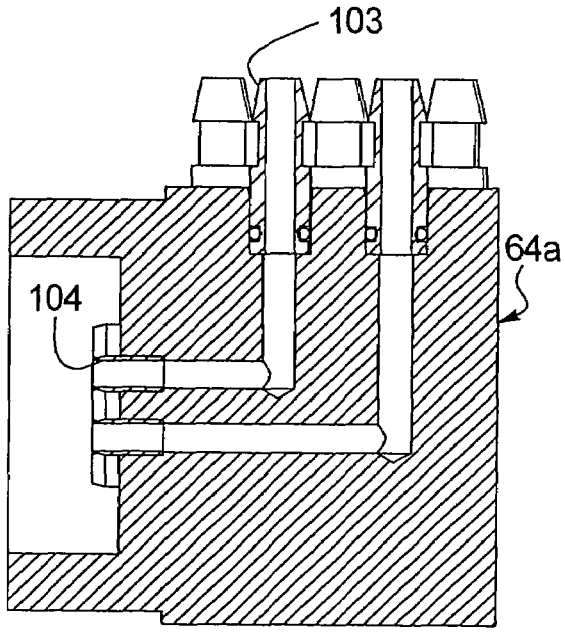
FIG. 19 is a sectional view taken substantially along the line 19-19 of FIG. 18.
Figure 20:
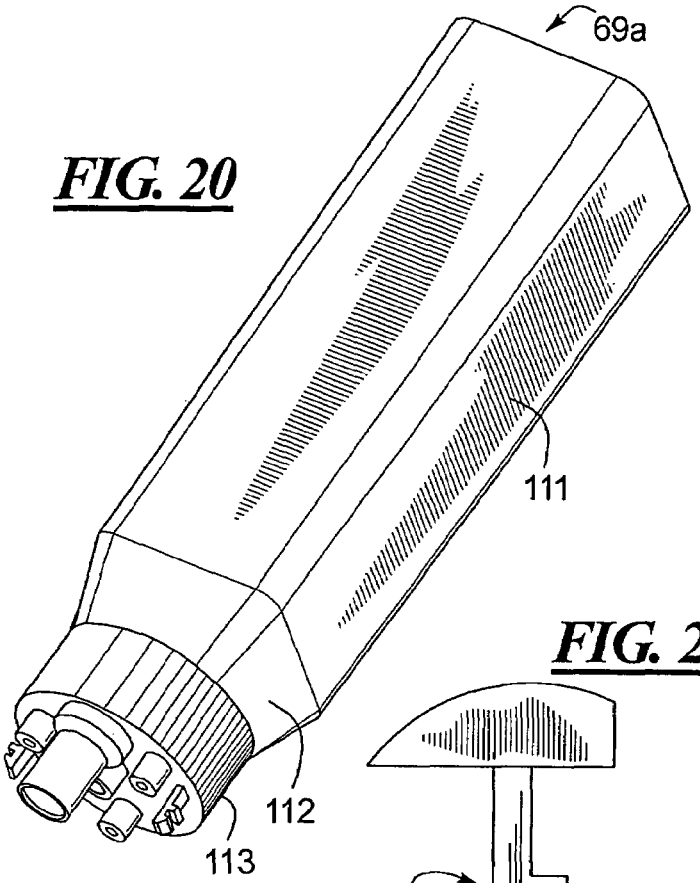
FIG. 20 is a perspective view of a vertical canister shown above in connection with FIGS. 4-6.
Figure 22:
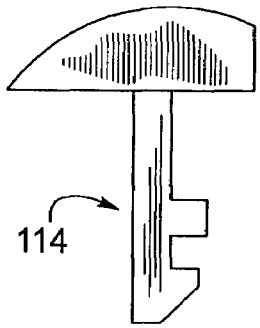
FIG. 22 is an enlarged partial view of the mounting tab for connecting the canister shown in FIGS. 20 and 21 to the module frame illustrated in FIGS. 5 and 6.
Figure 21:
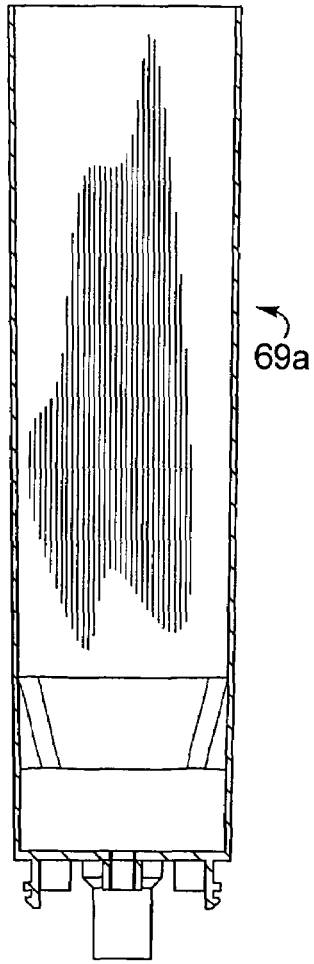
FIG. 21 is a sectional view of the canister shown in FIG. 20.
Figure 30:
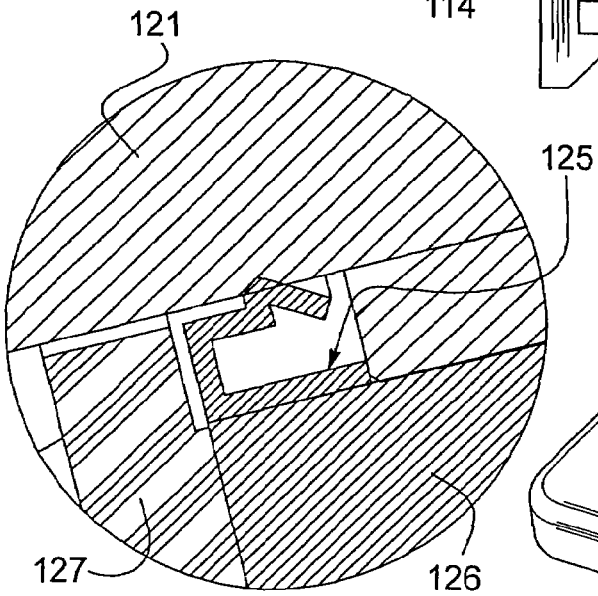
FIG. 30 is an enlarged partial view of the pump as shown in FIG. 29, particularly illustrating the drive shaft seal.
Figure 23:
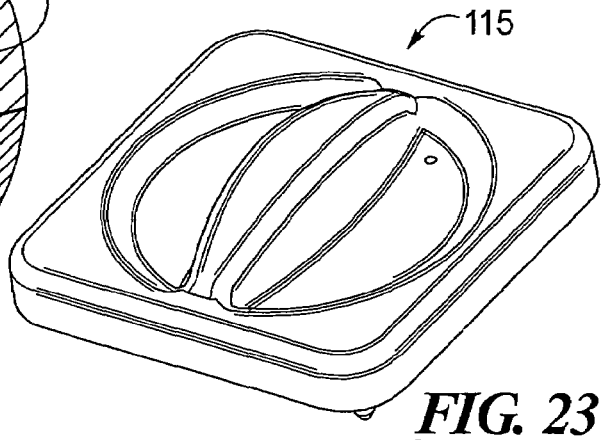
FIG. 23 is a perspective view of a top lid for the canister shown in FIGS. 20 and 21.

Turning to FIGS. 17-19, the manifold block 64*a* is described in greater detail. The block 64*a* includes an input end 101 and an output end 102 at a right angle thereto. The input end 101 includes a plurality of nozzles 103 that are connected to one of the pumps 74*a* or 74*b* (FIGS. 5-8). Each inlet nozzle 103 is in communication with an outlet nozzle 104 as shown in FIG. 19. Further, the outlet nozzles 104 are protected by a ring 105. The ring 105 is preferably sealingly engaged by a complementary sealing ring 96 of the closure mechanism 48*a*. Communication between the inlet nozzles 103 and outlet nozzles 104 are easily obtained by drilling two passages which are joined at a right angle as shown in FIG. 19.

Turning to FIGS. 20-23, the vertical canisters 69*a* are shown and described. The canisters 69*a* include an upper section 111 with a square or rectangular cross-section, a transition section 112 and a lower section 113 with a round cross-section. The upper portion 111 holds a greater amount of fluid as it can be stacked more closely to an adjacent canister as shown in FIG. 5 and therefore the upper sections with a rectangular or square cross-section provide a more efficient use of space. The lower section 113 with a round cross-section is required to more completely dispense all fluid contained within the canister 69*a* and therefore provides a more efficient use of the fluid provided in the canister 69*a*. The tab shown at 114 is used to secure the canister 69*a* to the upper portion 73*a* of the bracket 71*a* as shown in FIGS. 5 and 6. The lid 115 shown in FIG. 23 prevents the contents of the canister 69*a* from drying out.

Figure 24:
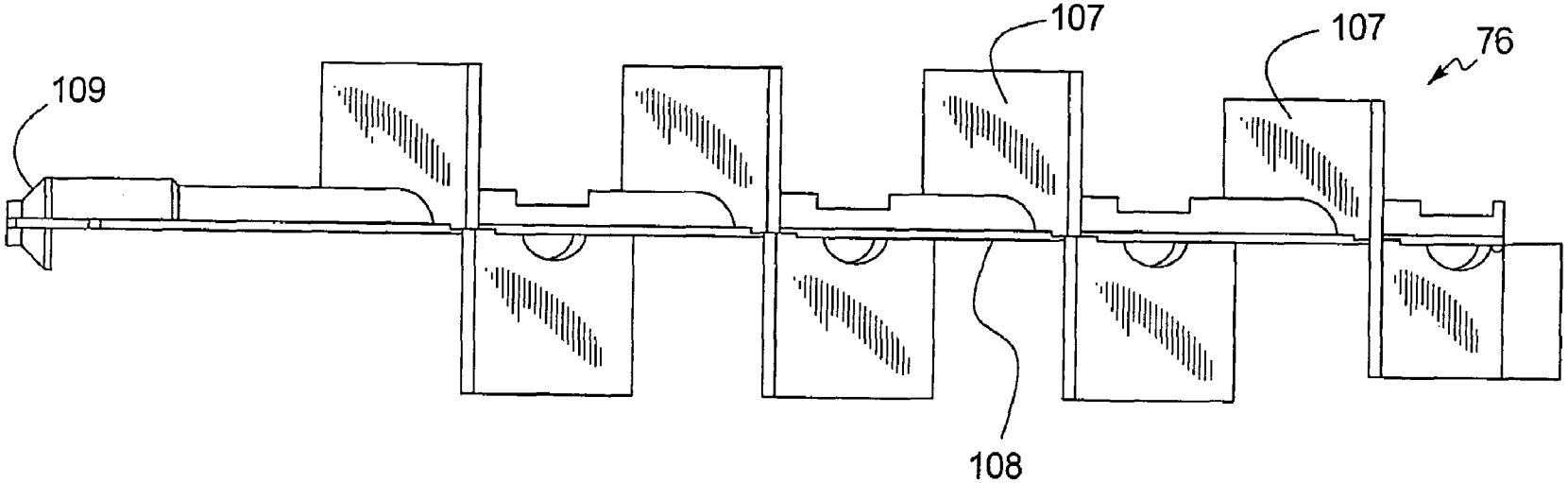
FIG. 24 is a plan view of an agitator paddle used in the vertical canister disclosed in FIGS. 20-23.
Figure 25:
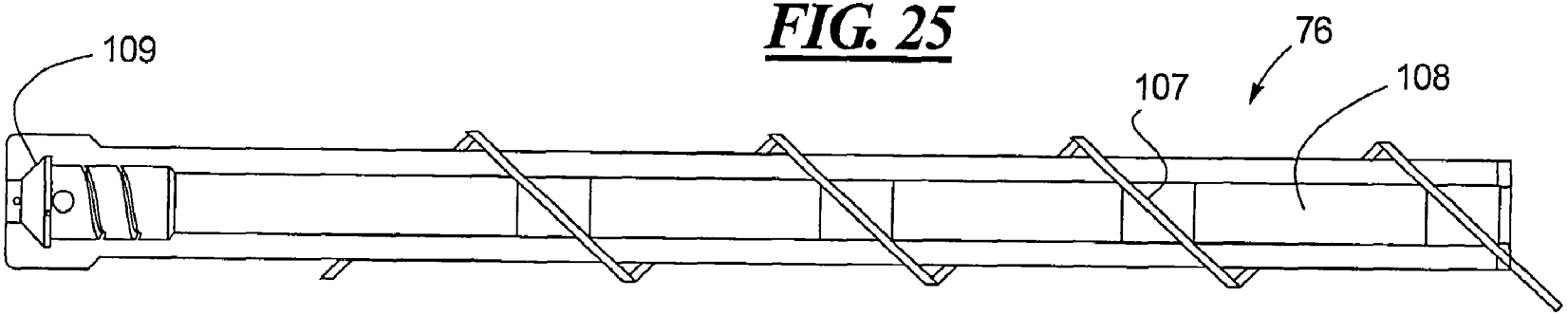
FIG. 25 is another side plan view of the agitator paddle shown in FIG. 24.

Turning to FIGS. 24 and 25, the agitator paddles 76 are shown in greater detail. Suitably placed fins 107 are mounted to a central shaft portion 108 and a lower fitting 109 secures the agitator paddle 76 to its respective drive shaft 77 as shown in FIGS. 5 and 6.

Figure 26:
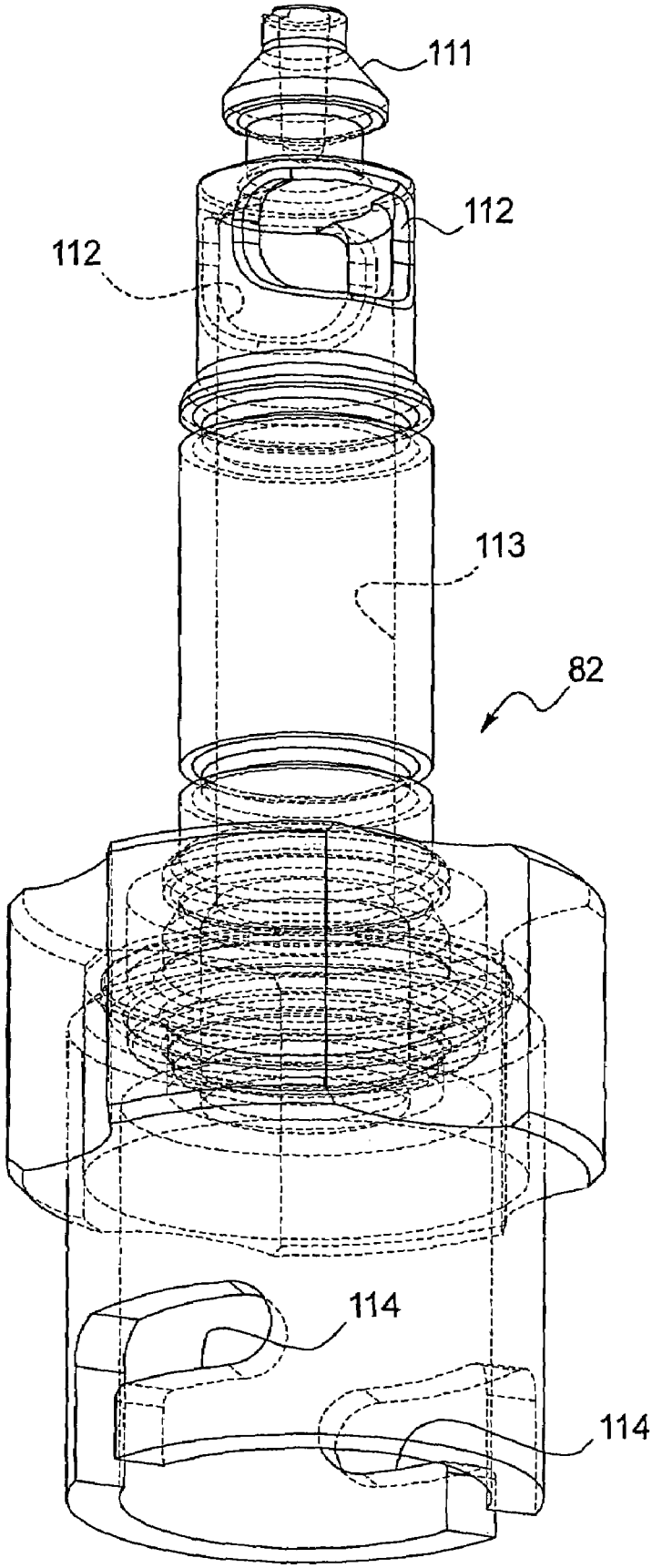
FIG. 26 is an elevation view of a nozzle used to connect a flexible bag to a pump as illustrated in FIGS. 7 and 8 above.

Turning to FIG. 26, the nozzle 82 for connecting a pump 74*b* to a flexible bag 69*b* as illustrated in FIG. 7 is shown and described. The nozzle 82 includes an upper plunger 111 that penetrates a seal on a lower portion of the bag. Diametrically opposed inlet ports are shown at 112 which enables fluid to be drawn down through the passageway shown at 113. The passageway 113 includes a ball (not shown) and also serves as a check valve to prevent fluid from being pumped upward into the bag thereby providing one-way flow to the pump 74*b*. Lock-fitting slots are shown at 114 to connect the nozzle 82 to the pump 74*b*.

Turning to FIGS. 27-30, the pumps 74*a* are illustrated in greater detail. The pump 74*a* includes a motor 117 which rotates a drive shaft 118. The drive shaft 118 (see FIG. 29) is connected to a coupling 119 which, in turn, is connected to a piston 121. The piston 121 includes a recess 122 and its rotation causes fluid to be drawn through the inlet 123 and out the outlet 78. One novel feature of the pump 74*a* shown in FIGS. 27-29 is the seal shown at 125 and illustrated in greater detail in FIG. 30. Specifically, the seal 125 provides a unique seal between the piston 121, casing 126 and the housing 127.

While only certain embodiments have been set forth, alternative embodiments and various modifications will be apparent from the above description to those skilled in the art. These and other alternatives are considered equivalents and within the spirit and scope of this disclosure.

What is claimed is:

1. A dispenser for dispensing a plurality of fluids, the dispenser comprising:

a controller, the controller linked to a coordinator board, the controller having a memory with a plurality of recipes stored therein, the coordinator board linked to a first module, the first module linked in series to a plurality of other modules, each module comprising a module board, the coordinator board linked to the module board of the first module, the module board of the first module being linked in series to the module boards of the other modules, each module board linked to at least one pump, each pump linked between its own reservoir and its own outlet nozzle, each outlet nozzle being mounted to a manifold block, the manifold block being supported within a manifold housing, each outlet nozzle being connected to an inlet end of the manifold block, the manifold block further comprising an outlet end, the manifold housing being connected to a closure mechanism for the outlet end of the manifold block, the closure mechanism comprising a motor linked to a manifold board for moving the closure mechanism between dispense and closed positions, the manifold board being linked in series to the other module boards, the controller, coordinator board and module boards being programmed for the simultaneous or sequential pumping of multiple fluids from the reservoirs and through the outlet nozzles in accordance with a selected recipe.

2. The dispenser of claim 1 wherein each module further comprises a module frame for supporting its respective module board, each module board being linked to a pair of pumps that are both supported by the module frame, the module frame also supporting each of a pair of reservoirs linked to the pumps, wherein the module board at least partially controls operation of both of said pair of pumps.

3. The dispenser of claim 2 further comprising a cabinet for housing the plurality of modules and wherein each module frame is detachably connected to the cabinet so that each module is replaceable.

4. The dispenser of claim 2 further comprising from 6 to 16 modules for the simultaneous dispensing of from 12 to 32 different fluids.

5. The dispenser of claim 2 wherein the pair of reservoirs of at least one module is a pair of vertical canisters and the pair of reservoirs of at least one other module is a pair of flexible bags.

6. The dispenser of claim 2 wherein the pumps of the modules are selected from the group consisting of nutating pumps, gear pumps, and piston pumps and the pumps of at least one module being different from the pumps of at least one other module.

7. The dispenser of claim 2 wherein the reservoirs of at least one module extends vertically upward from their respective pump and have a round cross section at a lower end of the reservoir and a rectangular cross section at an upper end of the reservoir.

8. The dispenser of claim 1 wherein each pump is connected to its respective outlet nozzle by a flexible hose, each outlet nozzle being mounted to a manifold block.

9. The dispenser of claim 1 wherein the closure mechanism comprises:

a supporting frame, the supporting frame being connected to a motor, the motor being connected to a threaded drive shaft, the drive shaft being directed towards the outlet end of the manifold block, the drive shaft being threadably coupled to a slide block, the slide block being slidably supported by the supporting frame, the slide block being pivotally connected to a bracket, the bracket being connected to an upwardly facing drip catcher, the bracket comprising a catch for engaging an abutment that pivots the bracket and drip catcher upward and towards the outlet end of the manifold block as the drip catcher and bracket approach the manifold block when the drive shaft is rotated to move the slide block, bracket and drip catcher towards the manifold block.

10. The dispenser of claim 9 wherein the abutment is disposed on an underside of the supporting frame.

11. The dispenser of claim 9 wherein the drip catcher comprises an upwardly facing rim that sealingly engages the outlet end of the manifold block.

12. The dispenser of claim 1 wherein the reservoir of at least one module comprises a vertical canister and the reservoir of at least one other module comprises a flexible bag.

13. The dispenser of claim 1 wherein the pumps of the modules are selected from the group consisting of nutating pumps, gear pumps, piston pumps and combinations thereof and the pump of at least one module is different from the pump of at least one other module.

14. The dispenser of claim 1 wherein the reservoir of at least one module extends vertically upward from its respective pump and has a round cross section at a lower end of the reservoir near said pump and a rectangular cross section at an upper end of the reservoir.

15. A dispenser for simultaneously dispensing a plurality of fluids, the dispenser comprising:

a central controller, the controller linked to a coordinator board, the controller having a memory with a plurality of recipes stored therein, a user interface for selecting a recipe;

the coordinator board linked to a first module, the first module linked in series to a plurality of other modules, each module comprising a module board, a pair of pumps and pair of reservoirs, the coordinator board linked to the module board of the first module, the module board of the first module being linked in series to the module boards of the other modules, each module board linked to the pair of pumps of its respective module, each pump linked between its own reservoir and its own outlet nozzle, each outlet nozzle being mounted to a manifold block, the manifold block being supported within a manifold housing, each outlet nozzle being connected to an inlet end of the manifold block, the manifold block further comprising an outlet end, the manifold housing being connected to a closure mechanism for the outlet end of the manifold block, the closure mechanism comprising a motor linked to a manifold board for moving the closure mechanism between dispense and closed positions, the manifold board being linked in series to the other module boards, the controller, coordinator board and module boards being programmed for the simultaneous or sequential pumping of multiple fluids from the reservoirs through the outlet nozzles in accordance with a selected recipe, each module further comprising a module frame for supporting its respective module board, pair of pumps and pair of reservoirs, the dispenser further comprising a cabinet for housing the modules, the module frame being detachably connected to the cabinet so that the modules are replaceable.

* * * * *